US010189670B2

(12) United States Patent
Yokawa et al.

(10) Patent No.: US 10,189,670 B2
(45) Date of Patent: Jan. 29, 2019

(54) PAPER SHEET HANDLING MACHINE AND PAPER SHEET HANDLING METHOD

(71) Applicant: GLORY LTD., Himeji-shi, Hyogo (JP)

(72) Inventors: Takeshi Yokawa, Hyogo (JP); Kazuaki Nishimura, Hyogo (JP); Hirokazu Goto, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/556,010

(22) PCT Filed: Feb. 8, 2016

(86) PCT No.: PCT/JP2016/053669

§ 371 (c)(1),
(2) Date: Sep. 6, 2017

(87) PCT Pub. No.: WO2016/143443

PCT Pub. Date: Sep. 15, 2016

(65) Prior Publication Data

US 2018/0057302 A1 Mar. 1, 2018

(30) Foreign Application Priority Data

Mar. 6, 2015 (JP) ..... 2015-044633

(51) Int. Cl.
*B65H 7/02* (2006.01)
*B65H 43/00* (2006.01)
(Continued)

(52) U.S. Cl.
CPC ..... *B65H 43/00* (2013.01); *B65H 7/02* (2013.01); *B65H 9/00* (2013.01); *B65H 9/163* (2013.01);
(Continued)

(58) Field of Classification Search
CPC ..... B65H 29/006; B65H 2511/162; B65H 2511/164; B65H 2511/13;
(Continued)

(56) References Cited

U.S. PATENT DOCUMENTS 6,739,590 B2 * 5/2004 Otsuka ..... B65H 7/08 271/227
7,651,088 B2 * 1/2010 Stenzel ..... B65H 29/00 271/184
(Continued)

FOREIGN PATENT DOCUMENTS

EP 1 637 487 A2 3/2006
JP 2002-316745 A 10/2002
(Continued)

OTHER PUBLICATIONS

Written Opinion of the International Searching Authority (International Application No. PCT/JP2016/053669) (6 pages—dated Mar. 15, 2016).
Japanese Office Action with English Translation (Application No. 2017-504926) (7 pages—dated Oct. 11, 2018).
(Continued)

*Primary Examiner* — Jeremy R Severson
(74) *Attorney, Agent, or Firm* — Renner, Kenner, Greive, Bobak, Taylor & Weber

(57) ABSTRACT

A paper sheet handling machine (for example, a banknote handling machine (10)) includes: a storage unit (for example, an escrow unit (20), banknote storages (30), a banknote storage cassette (40)) configured to store a paper sheet transported from a transport unit (16); and a shifting unit (19) provided in the transport unit (16) and configured to shift the paper sheet transported by the transport unit (16), in a width direction orthogonal to a direction in which the paper sheet is transported, according to a position, in the width direction, of a specific member (for example, a tape (136) in the escrow unit (20), a pair of feed rollers of a banknote feeding mechanism (32, 42) provided in the banknote storages (30), a banknote storage cassette (40)) in the storage unit.

8 Claims, 14 Drawing Sheets

(51) Int. Cl.

| | |
|---|---|
| ***B65H 9/00*** | (2006.01) |
| ***G07D 9/00*** | (2006.01) |
| ***B65H 9/16*** | (2006.01) |
| ***B65H 29/00*** | (2006.01) |
| ***G07D 11/00*** | (2006.01) |
| ***G07F 19/00*** | (2006.01) |

(52) U.S. Cl.
CPC ..... *B65H 29/006* (2013.01); *G07D 9/00* (2013.01); *G07D 11/0021* (2013.01); *G07F 19/202* (2013.01); *G07F 19/203* (2013.01); *B65H 2511/13* (2013.01); *B65H 2511/162* (2013.01); *B65H 2701/1125* (2013.01); *B65H 2701/172* (2013.01); *B65H 2701/1912* (2013.01)

(58) Field of Classification Search
CPC ..... B65H 2701/1125; B65H 2701/172; B65H 2701/1912; B65H 9/163
See application file for complete search history.

(56) References Cited

U.S. PATENT DOCUMENTS

| | | | |
|---|---|---|---|
| 2006/0070840 | A1 | 4/2006 | Hayashi et al. |
| 2007/0045940 | A1 | 3/2007 | Stenzel et al. |
| 2011/0174051 | A1 | 7/2011 | Sacquard et al. |
| 2014/0238815 | A1 | 8/2014 | Iwamura et al. |

FOREIGN PATENT DOCUMENTS

| | | | | |
|---|---|---|---|---|
| JP | 2003-192146 | A | | 7/2003 |
| JP | 2006111446 | A | * | 4/2006 |
| JP | 2013-250667 | A | | 12/2013 |
| JP | 2015-27912 | A | | 2/2015 |
| WO | WO 2014/208657 | A1 | | 12/2014 |

OTHER PUBLICATIONS

European Search Report (Application No. 16761415.5—PCT/JP2016/053669) (8 pages—dated Nov. 29, 2011).

* cited by examiner (a)

(b)

PAPER SHEET HANDLING MACHINE AND PAPER SHEET HANDLING METHOD

TECHNICAL FIELD

The present invention relates to a paper sheet handling machine that handles paper sheets, and a paper sheet handling method performed by the paper sheet handling machine.

BACKGROUND ART

To date, various types of banknote depositing and dispensing apparatus have been used as automatic cash transaction apparatus such as teller machines or ATMs (automated teller machines) installed in financial facilities and the like. A plurality of types of banknotes are handled by the automatic cash transaction apparatus such as a teller machine or an ATM, and the size and material of each banknote is different depending on the type. Therefore, a banknote depositing and dispensing apparatus that can appropriately handle various types of banknotes is required for the automatic cash transaction apparatus such as a teller machine and an ATM. In order to address this requirement, Japanese Laid-Open Patent Publication No. 2006-111446 discloses a paper sheet handling apparatus which has shifting means that corrects a position, in the width direction, of a paper sheet being transported from an escrow unit, and a recognition unit checks, the result of the positioning, in the width direction, of the paper sheet having been corrected by the shifting means. In such a paper sheet handling apparatus, the positions, in the width direction, of various sizes of paper sheets can be stably altered.

Furthermore, in some cases, an automatic cash transaction apparatus such as a teller machine or an ATM includes a plurality of banknote storing and feeding units in a housing, each of which winds banknotes onto the outer circumferential surface of a rotating member such as a drum, one by one, by using a belt-shaped tape, to store a plurality of banknotes, and unwinds, one by one, the banknotes which have been wound onto the outer circumferential surface of the rotating member, by unwinding the tape from the rotating member. In such an automatic cash transaction apparatus, the banknotes are inserted into the housing, recognized by a recognition unit, and stored, for example, according to denominations in the banknote storing and feeding units. Furthermore, in a case where the automatic cash transaction apparatus includes an escrow unit, when the escrow unit has a structure that is almost the same as the structure of the banknote storing and feeding unit described above, banknotes are inserted into a housing from a hopper, recognized by a recognition unit, and temporarily stored in the escrow unit having the structure similar to the structure of the banknote storing and feeding unit described above.

SUMMARY OF THE INVENTION

In recent years, use of hybrid banknotes in which paper and polymer films are combined began in some countries and regions. Specifically, a hybrid banknote is formed by a polymer film being adhered to a portion of a banknote. Alternatively, a hybrid banknote may be formed by a polymer film that extends linearly in the short edge direction of the banknote and is sandwiched between paired paper portions. However, the polymer film of the hybrid banknote has a higher stiffness than the paper portion, and, furthermore, the polymer film has a greater thickness than the paper portion. Therefore, in a case where the banknote storing and feeding unit described above is used in the automatic cash transaction apparatus such as a teller machine or an ATM, various problems may arise when the hybrid banknotes are stored in or fed by the banknote storing and feeding unit.

Specifically, since the polymer film of the hybrid banknote has a higher stiffness than the paper portion, when the hybrid banknote is wound, by a belt-shaped tape, onto the outer circumferential surface of the rotating member such as a drum in the banknote storing and feeding unit, a problem arises in that a force with which the tape presses the hybrid banknote against the outer circumferential surface of the rotating member is lower as compared to a case where a banknote formed only from paper is wound, by the belt-shaped tape, onto the outer circumferential surface of the rotating member. Furthermore, in the case where a plurality of belt-shaped tapes are provided so as to be arranged in alignment in the axial direction of the rotating member such as a drum, a pressing force of the tape which is closest to the polymer film of the hybrid banknote is lower than a pressing force of the tape which is farthest from the polymer film. In this case, since the tape closest to the polymer film of the hybrid banknote expands outward of the rotating member when a plurality of the hybrid banknotes have been wound onto the outer circumferential surface of the rotating member, a so-called conical shape is formed by the plurality of hybrid banknotes that have been wound, by each tape, onto the outer circumferential surface of the rotating member, as viewed in the direction orthogonal to the axis of the rotating member. Consequently, the positions of the hybrid banknotes stored on the rotating member may become displaced in the axial direction of the rotating member.

Such a state will be described with reference to FIG. 16. As shown in FIG. 16, when a plurality of hybrid banknotes (represented as reference character P in FIG. 16) have been wound onto the outer circumferential surface of a rotating member (specifically, drum) 500, a tape portion which is closer to a polymer film portion (represented as reference character $P_2$ in FIG. 16) of the hybrid banknote expands outward of the rotating member. Therefore, a conical shape is formed by the plurality of hybrid banknotes that have been wound, by each tape, onto the outer circumferential surface of the rotating member 500 as shown in FIG. 16, as viewed from the front side of the rotating member 500. In this case, the positions of the hybrid banknotes stored on the rotating member 500 may be displaced in the axial direction of the rotating member 500.

Furthermore, in a case where a cassette-type storing and feeding unit, in which a plurality of banknotes are stored in a stacked state, is used for an automatic cash transaction apparatus such as a teller machine or an ATM, when banknotes stored in the storing and feeding unit are fed, one by one, from the storing and feeding unit by using a pair of left and right feed rollers in the storing and feeding unit, if a polymer film of the hybrid banknote contact with one of the feed rollers, and a paper portion of the hybrid banknote contacts with the other of the feed rollers, since a coefficient of friction of the polymer film relative to the feed roller and a coefficient of friction of the paper portion relative to the feed roller are different, the hybrid banknote fed by the pair of feed rollers may be skewed.

The present invention is made in view of these circumstances, and an object of the present invention is to provide a paper sheet handling machine and a paper sheet handling method that allow specific paper sheets such as hybrid banknotes to be appropriately stored in a storage unit, and allow the specific paper sheets to be appropriately fed from the storage unit.

A paper sheet handling machine of the present invention includes: a transport unit configured to transport a paper sheet; a storage unit configured to store the paper sheet transported from the transport unit; and a shifting unit provided in the transport unit and configured to shift the paper sheet being transported by the transport unit, in a width direction orthogonal to a direction in which the paper sheet is transported, according to a position, in the width direction, of a specific member in the storage unit.

The paper sheet handling machine of the present invention may further include a recognition unit provided in the transport unit and configured to detect a predetermined feature portion of the paper sheet transported by the transport unit, and the shifting unit may shift the paper sheet in the width direction, on the basis of a position, in the width direction, of the predetermined feature portion recognized in the paper sheet by the recognition unit.

In this case, the storage unit has, as the specific member, a belt-shaped winding member for winding the paper sheet onto an outer circumferential surface of a rotating member for winding the paper sheet, and the shifting unit may shift the paper sheet in the width direction such that a position, in the width direction, of the predetermined feature portion of the paper sheet to be stored in the storage unit at least partially overlaps a position, in the width direction, of the winding member in the storage unit.

Alternatively, the storage unit has, as the specific member, a feeding member for feeding, from the storage unit, paper sheets stored in the storage unit in a stacked state, and the shifting unit may shift the paper sheets in the width direction such that a position, in the width direction, of the predetermined feature portion of each paper sheet to be stored in the storage unit is displaced from a position, in the width direction, of the feeding member in the storage unit.

Furthermore, the recognition unit and the shifting unit may be connected by a linear transport path in the transport unit.

Furthermore, the predetermined feature portion of the paper sheet may be a portion, of a banknote, formed from a material other than paper.

In the paper sheet handling machine of the present invention, a recognition unit that detects a predetermined feature portion of the paper sheet transported by the transport unit may be disposed upstream or downstream of the shifting unit in a direction in which the paper sheet is transported by the transport unit. A feature portion detection unit that detects a position, in the width direction, of the predetermined feature portion of the paper sheet may be disposed on a side, in the transport unit, opposite to a side on which the recognition unit is disposed, with respect to the shifting unit. A shift distance over which the paper sheet is shifted in the width direction by the shifting unit may be calculated on the basis of a result of recognition by the recognition unit and a result of detection by the feature portion detection unit.

In the paper sheet handling machine of the present invention, the storage unit may include a paper sheet feeding mechanism that feeds, into the transport unit, a paper sheet stored in the storage unit, and a storage space shifting mechanism that shifts a space in which the paper sheet is stored, in a direction orthogonal to a direction in which the paper sheet is fed by the paper sheet feeding mechanism.

A paper sheet handling method of the present invention includes: transporting, by a transport unit, a paper sheet in a paper sheet handling machine; shifting, by a shifting unit, the paper sheet transported by the transport unit, in a width direction orthogonal to a direction in which the paper sheet is being transported, according to a position, in the width direction, of a specific member in a storage unit; and storing, in the storage unit, the paper sheet shifted in the width direction by the shifting unit.

The paper sheet handling method of the present invention may further include detecting, by a recognition unit, a predetermined feature portion of the paper sheet. The shifting unit may shift the paper sheet in the width direction on the basis of a position, in the width direction, of the predetermined feature portion recognized in the paper sheet by the recognition unit.

In the paper sheet handling method of the present invention, the predetermined feature portion of the paper sheet may be a portion, of a banknote, formed from a material other than paper.

DESCRIPTION OF EMBODIMENTS

Figure 1:
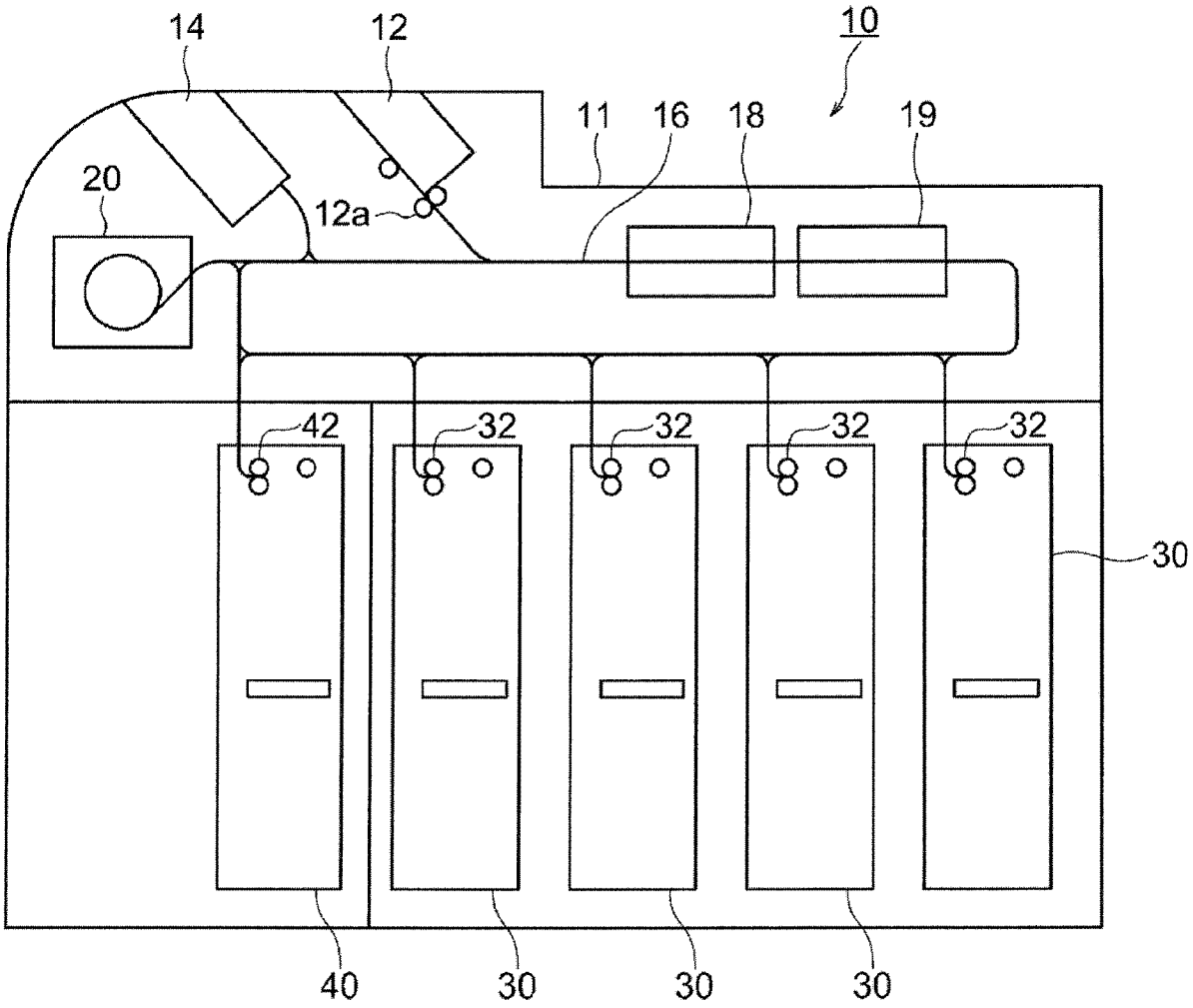
FIG. 1 schematically illustrates an exemplary structure of a banknote handling machine according to an embodiment of the present invention.
Figure 2:
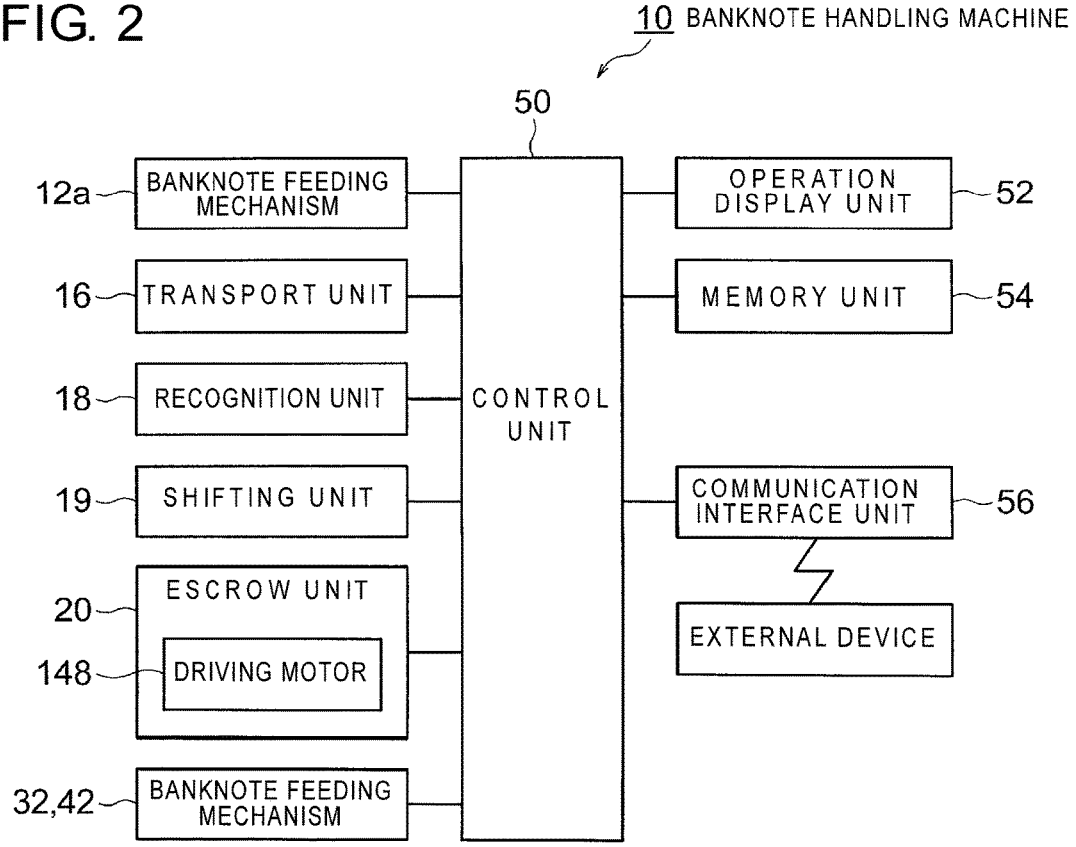
FIG. 2 is a functional block diagram illustrating a configuration of a control system of the banknote handling machine shown in FIG. 1.
Figure 3:
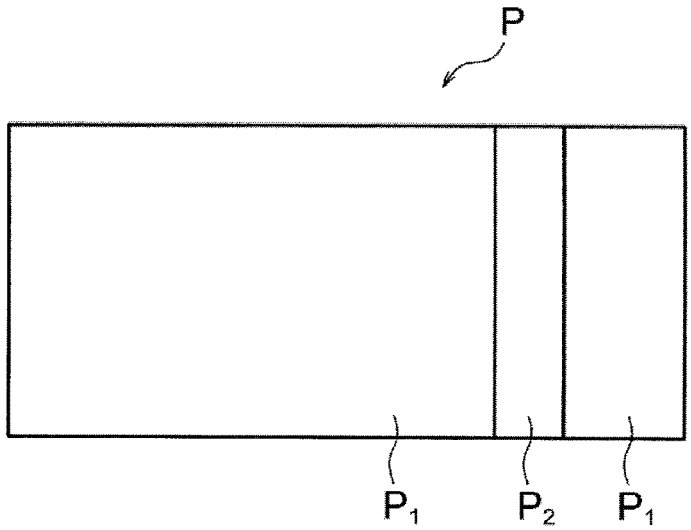
FIG. 3 illustrates a structure of a hybrid banknote to be handled by the banknote handling machine shown in FIG. 1.
Figure 4:
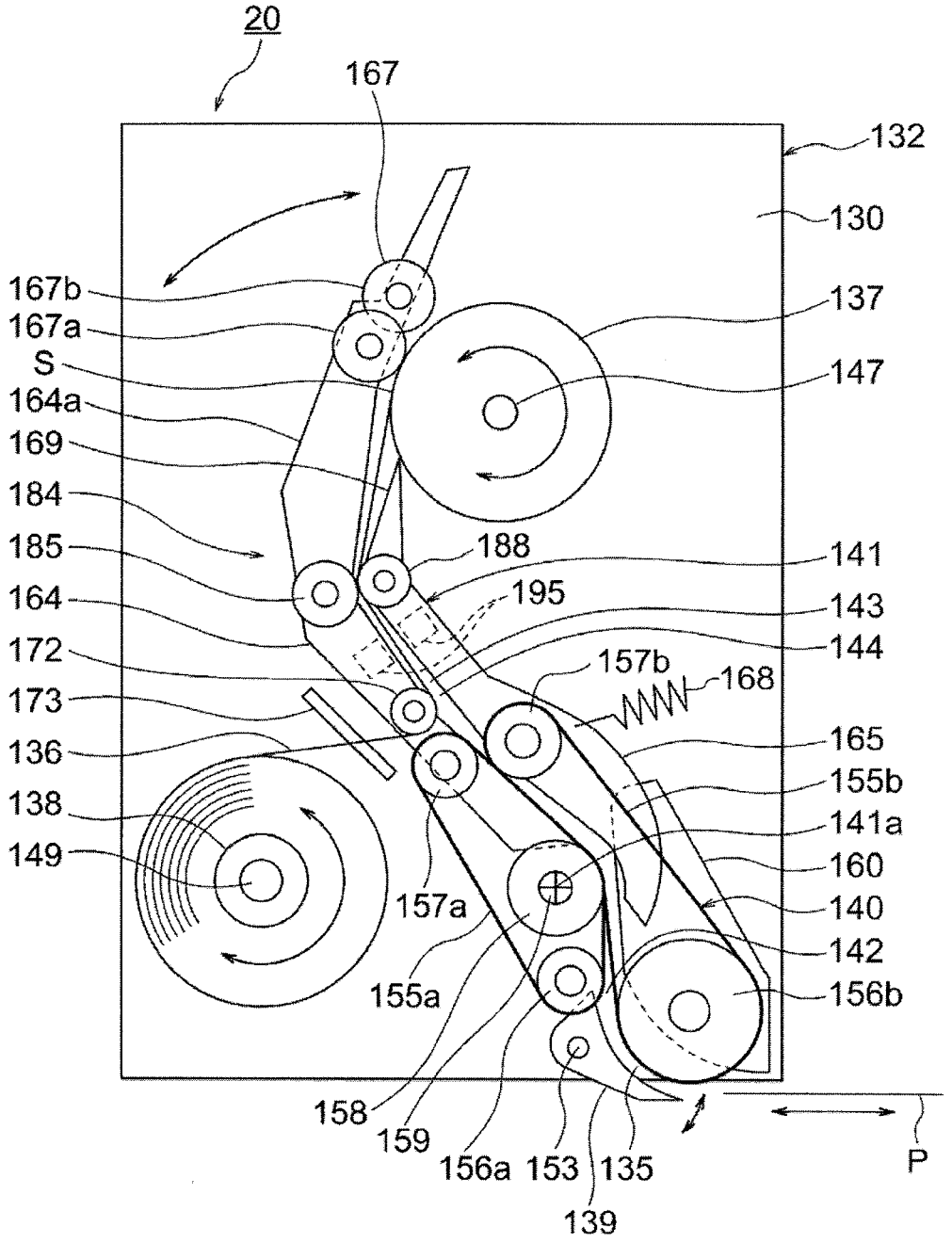
FIG. 4 is a side view of a structure of an escrow unit in the banknote handling machine shown in FIG. 1, illustrating a state where no banknote is wound on a drum.
Figure 5:
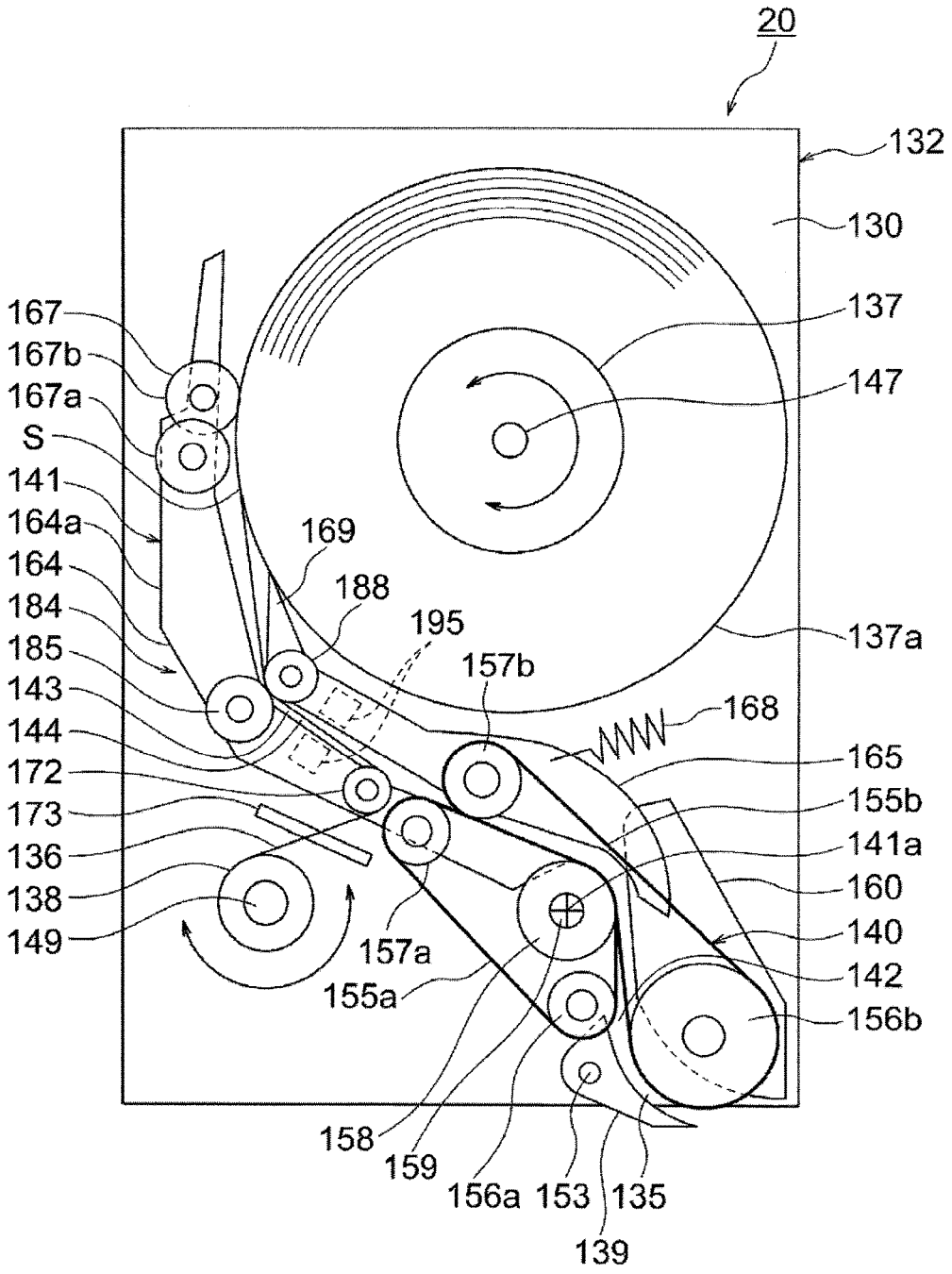
FIG. 5 is a side view of a structure of the escrow unit in the banknote handling machine shown in FIG. 1, illustrating a maximum wound state where winding of a tape and banknotes onto the drum is maximum.
Figure 6:
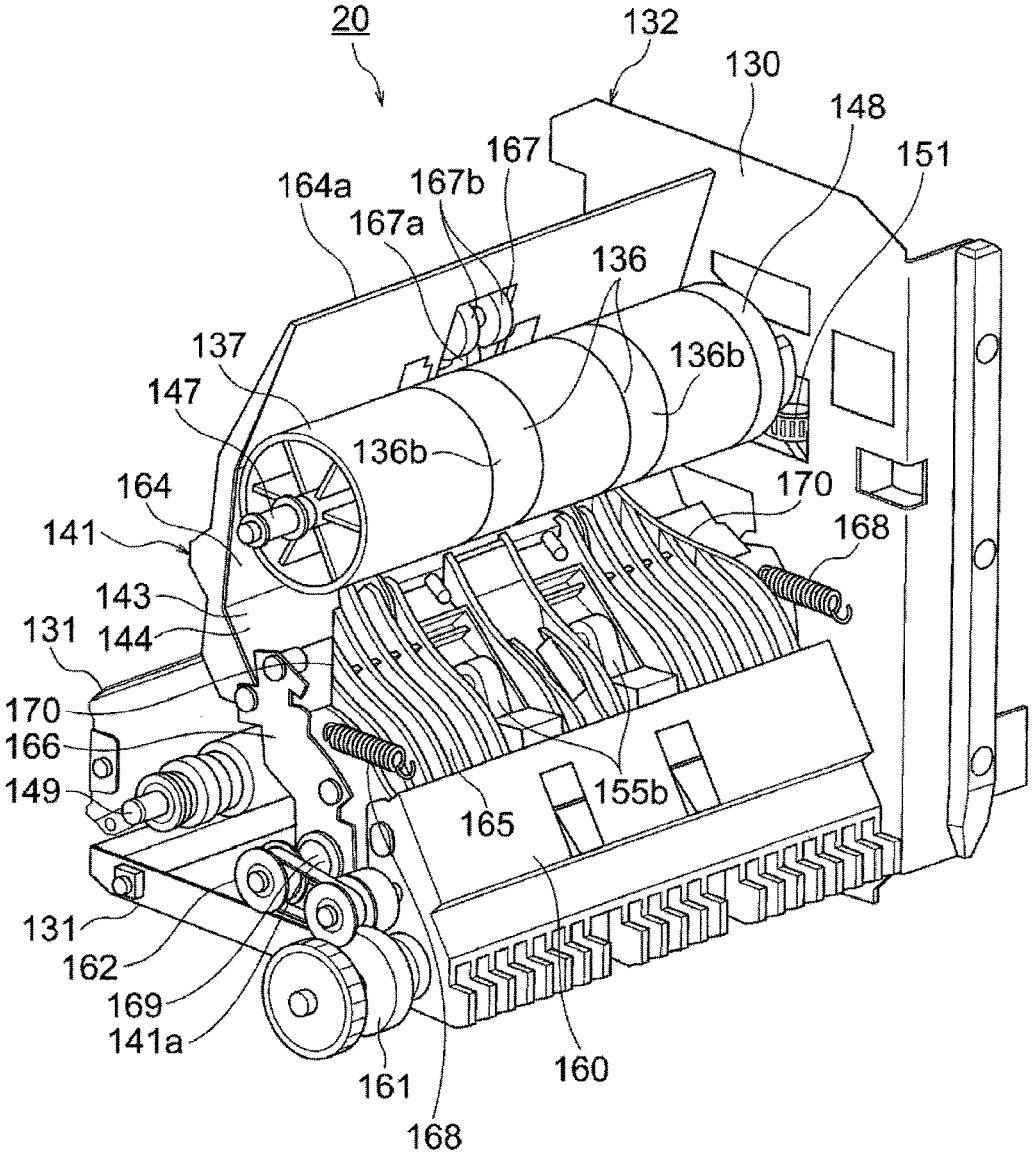
FIG. 6 is a perspective view of components near the drum in the escrow unit shown in FIG. 4 and FIG. 5.
Figure 7:
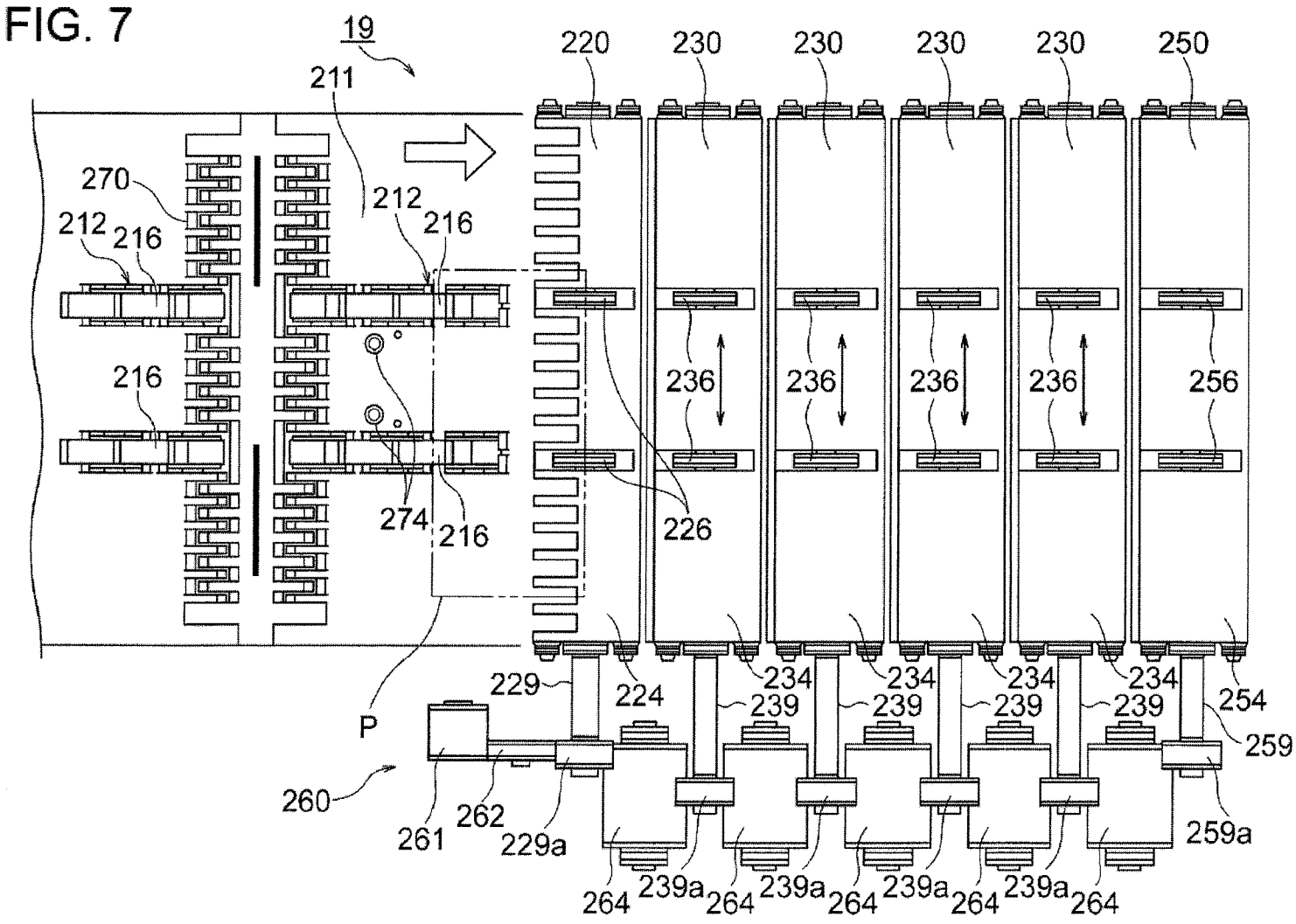
FIG. 7 is a top view of a structure of a shifting unit in the banknote handling machine shown in FIG. 1.
Figure 8:
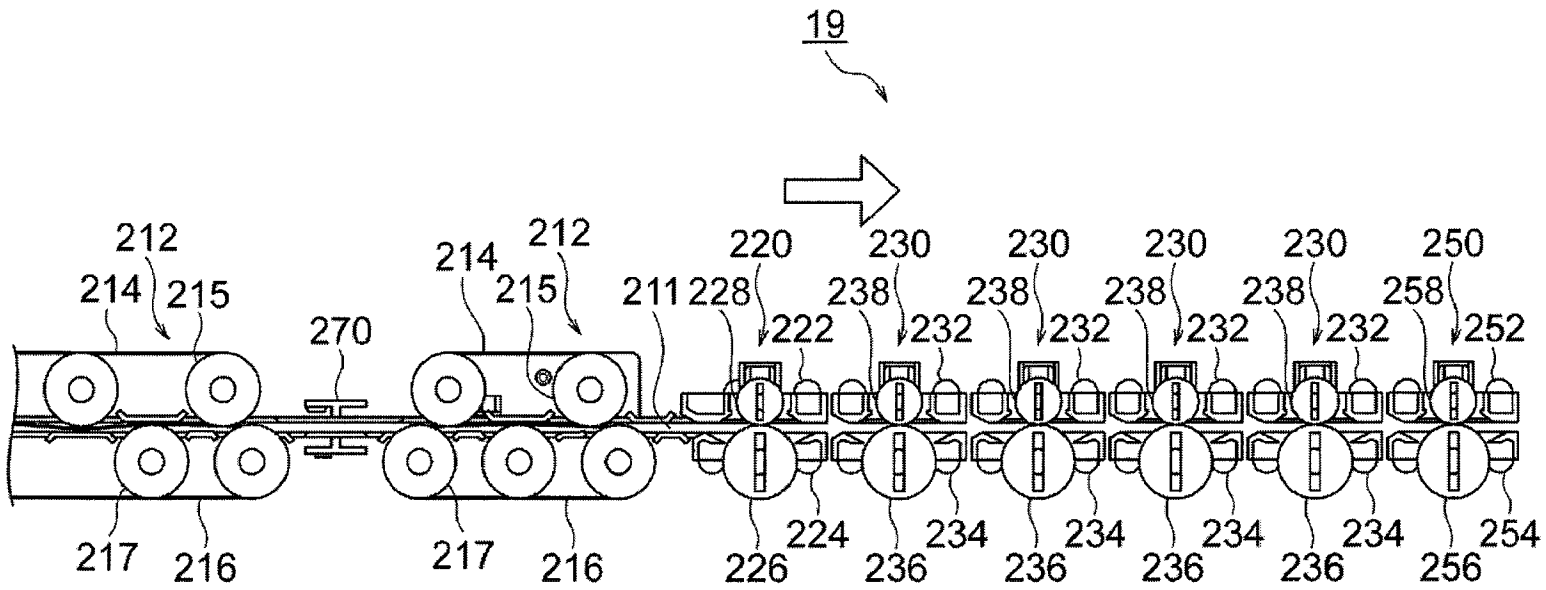
FIG. 8 is a side view of the shifting unit shown in FIG. 7.
Figure 9:
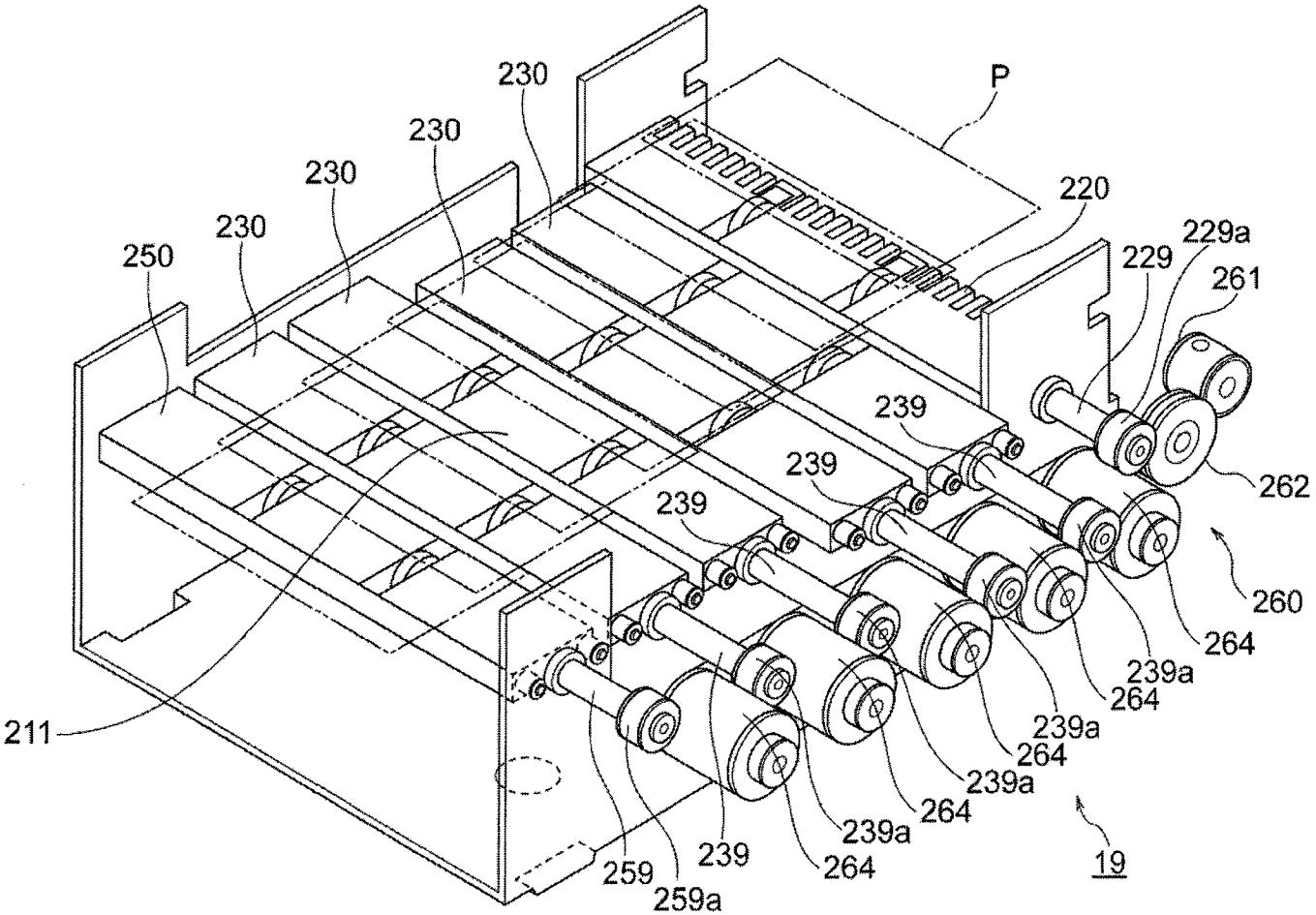
FIG. 9 is a perspective view of the shifting unit shown in FIG. 7 and FIG. 8.

An embodiment of the present invention will be described below with reference to the drawings. FIG. 1 to FIG. 11 illustrate a banknote handling machine and a banknote handling method according to the present embodiment. Among them, FIG. 1 schematically illustrates an exemplary structure of the banknote handling machine according to the present embodiment. FIG. 2 is a functional block diagram illustrating a configuration of a control system of the banknote handling machine shown in FIG. 1. Furthermore, FIG. 3 illustrates a hybrid banknote to be handled by the banknote handling machine shown in FIG. 1. Furthermore, FIG. 4 and FIG. 5 are each a side view of a structure of an escrow unit in the banknote handling machine shown in FIG. 1. FIG. 6 is a perspective view of components near a drum in the escrow unit shown in FIG. 4 and FIG. 5. Furthermore, FIG. 7 to FIG. 9 are a top view, a side view, and a perspective view, respectively, of a structure of a shifting unit in the banknote handling machine shown in FIG. 1. Furthermore, FIG. 10 and FIG. 11 each illustrate an operation of shifting a banknote by the shifting unit shown in FIG. 7 to FIG. 9.

As shown in FIG. 1, a banknote handling machine 10 of the present embodiment includes: a housing 11 having an almost rectangular parallelepiped shape; an inlet unit 12 through which a banknote is inserted from the outside of the housing 11 into the inside thereof; and a discharge unit 14 through which a banknote is discharged from the inside of the housing 11 to the outside. Furthermore, a transport unit 16 for transporting banknotes one by one is provided in the housing 11 of the banknote handling machine 10. The inlet unit 12 includes, for example, a hopper on which a plurality of banknotes is placed by an operator so as to be stacked, and the inlet unit 12 includes a banknote feeding mechanism 12*a* that feeds the placed banknotes, one by one, into the housing 11 and transports the banknotes to the transport unit 16. In such a structure, the banknotes placed on the inlet unit 12 are fed one by one into the housing 11 by the banknote feeding mechanism 12*a*, and transported to the transport unit 16, and are thereafter transported one by one inside the housing 11 by the transport unit 16. In the present embodiment, a bundle of banknotes is inserted into the inlet unit 12 along the short edge direction, and the transport unit 16 transports the banknotes along the short edge direction. Furthermore, a recognition unit 18 is disposed in the transport unit 16, and recognition of denominations, authentication, recognition of face/back, recognition of fitness, recognition of old/new version, recognition of a transported state, and the like for the banknotes transported by the transport unit 16 are performed by the recognition unit 18. Furthermore, a shifting unit 19 is disposed in the transport unit 16, and the shifting unit 19 shifts positions of banknotes transported by the transport unit 16, along a direction (that is, the width direction of the banknotes transported by the transport unit 16) orthogonal to a direction in which the banknotes are transported by the transport unit 16. As shown in FIG. 1, the recognition unit 18 and the shifting unit 19 are connected by a linear transport path in the transport unit 16. Such a structure of the shifting unit 19 will be described below in detail. Moreover, an escrow unit 20 is connected to the transport unit 16, and a banknote recognized by the recognition unit 18 is transported to the escrow unit 20 by the transport unit 16, and escrowed in the escrow unit 20. Such a structure of the escrow unit 20 will be described below in detail.

Furthermore, as shown in FIG. 1, a plurality (four in the example shown in FIG. 1) of banknote storages 30 are aligned in parallel in the housing 11 of the banknote handling machine 10, and each of the banknote storages 30 is connected to the transport unit 16. In each banknote storage 30, a plurality of banknotes is stored in a stacked state. Furthermore, in the banknote storages 30, banknotes are stored according to denomination. In such a structure, the banknotes escrowed in the escrow unit 20 are fed from the escrow unit 20 into the transport unit 16 on the basis of the result of recognition of the banknotes by the recognition unit 18, and transported to the banknote storages 30 by the transport unit 16 according to denomination. Furthermore, each banknote storage 30 includes a banknote feeding mechanism 32 for feeding banknotes stored in the banknote storage 30, one by one, into the transport unit 16.

Furthermore, as shown in FIG. 1, a banknote storage cassette 40 is detachably mounted in the housing 11 of the banknote handling machine 10. In the banknote storage cassette 40, a plurality of banknotes is stored in a stacked state. Furthermore, when the banknote storage cassette 40 is mounted in the housing 11, a banknote is transported from the transport unit 16 into the banknote storage cassette 40. After banknotes are stored in the banknote storage cassette 40, the banknote storage cassette 40 is removed from the housing 11, whereby an operator can collect the banknotes together with the banknote storage cassette 40 from the banknote handling machine 10. Furthermore, the banknote storage cassette 40 includes a banknote feeding mechanism 42 for feeding banknotes stored in the banknote storage cassette 40, one by one, into the transport unit 16 when the banknote storage cassette 40 is mounted in the housing 11. In such a structure, each of the banknote storages 30 can be refilled with banknotes from the banknote storage cassette 40 by the banknote storage cassette 40, mounted in the housing 11, having banknotes stored therein.

Next, the structure of the escrow unit 20 provided in the banknote handling machine 10 of the present embodiment will be described in detail with reference to FIG. 4 to FIG. 6. FIG. 4 is a side view of the structure of the escrow unit 20 in the banknote handling machine 10 shown in FIG. 1, illustrating a state where no banknote is wound on a drum 137. FIG. 5 is a side view of the structure of the escrow unit 20 in the banknote handling machine 10 shown in FIG. 1, illustrating a maximum wound state where winding of a tape 136 and banknotes onto the drum 137 is at a maximum. Furthermore, FIG. 6 is a perspective view of components near the drum 137 in the escrow unit 20 shown in FIG. 4 and FIG. 5. In the present embodiment, the escrow unit 20 functions as a banknote storing and feeding apparatus that can store banknotes and feed out the banknotes stored therein. Furthermore, in FIG. 4, reference character P represents a banknote that has not yet been transported to the escrow unit 20, or a banknote that has been fed from the escrow unit 20.

As shown in FIG. 4 to FIG. 6, the escrow unit 20 has a frame 132 that has a rectangular parallelepiped shape and that includes side plates 130 on both sides and a plurality of connecting members 131 that connect the side plates 130 with each other.

One surface of the frame 132 is formed as a path surface that opposes the transport unit 16 and forms a part of the transport unit 16, and an outlet and inlet 135 is formed as an opening in the path surface so as to insert a banknote (represented as reference character P in FIG. 4) from the transport unit 16 and discharge a banknote into the transport unit 16.

The following items and the like, are disposed between both side plates 130 of the frame 132: the cylindrical drum 137 to which one end of the tape 136 is attached, a disk-shaped reel 138 to which the other end of the tape 136 is attached, a diverging lever 139 that operates to take a banknote transported by the transport unit 16 through the outlet and inlet 135 and guide a banknote fed through the outlet and inlet 135 into the transport unit 16, a transport mechanism 140 connected to the outlet and inlet 135 for transporting banknotes, a swingable guide member 141 that guides the tape 136 and a banknote between the transport mechanism 140 and the circumferential surface of the drum 137.

The drum 137 is disposed in almost the center region between the side plates 130, the reel 138 is aligned with the outlet and inlet 135 and the transport mechanism 140 laterally thereto, and the guide member 141 is disposed between the drum 137 and the reel 138 so as to be swingable.

A fixed path 142 is formed by the transport mechanism 140 so as to extend along a direction from the outlet and inlet 135 toward the drum 137 and connect the outlet and inlet 135 and the guide member 141. A guide path 143 is formed in the guide member 141 for guiding the tape 136 and a banknote. The guide path 143 is formed as a swing path 144 since the guide member 141 swings.

When the banknote transported from the transport unit 16 is escrowed in the escrow unit 20, the banknote is taken in through the outlet and inlet 135, and transported to the drum 137 through the transport mechanism 140 and the guide member 141. The banknote is wound together with the tape 136 onto the drum 137, and the banknote is stored on the drum 137. Meanwhile, when the banknote escrowed in the escrow unit 20 is fed into the transport unit 16, the banknote is unwound from the drum 137 into the guide member 141 by the tape 136 being wound onto the reel 138, that is, the tape 136 being unwound from the drum 137, and fed through the transport mechanism 140 to the outlet and inlet 135.

Furthermore, the tape 136 has a width that is less than the banknote width orthogonal to the direction in which a banknote is transported, that is, the width (hereinafter, merely referred to as width of banknote) in the long edge direction of a banknote. As shown in FIG. 6, the number of tapes 136 used is two, and the two tapes 136 are aligned in parallel so as to be spaced from each other in the axial direction of the drum 137 and the reel 138. Therefore, the two tapes 136 are wound onto the drum 137 in a state where the two tapes 136 press the banknote at two portions thereof in the width direction. The center portion and both side portions of the banknote in the width direction are exposed between the two tapes 136 and from both sides of the two tapes 136 in a wound state.

Each tape 136 is formed from, for example, a transparent film material having a predetermined or higher light transmittance, and has, for example, a non-transparent portion that does not have a predetermined or higher light transmittance and that is used for detecting a limit of unwinding from the drum 137, in one end region which is attached to the drum 137. Furthermore, the tape 136 also has, for example, a non-transparent portion that does not have a predetermined or higher light transmittance and that is used for detecting a limit of winding onto the drum 137, in the other end region which is attached to the reel 138. These non-transparent portions are formed from, for example, non-transparent seals, and are adhered to each of the two tapes 136.

A face, of each tape 136, which is on the inner diameter side in the case of the tape 136 being wound onto the drum 137 and the reel 138, is referred to as a first face 136*a*, and a face, of the tape 136, which is on the outer diameter side in the case thereof is referred to as a second face 136*b*.

Furthermore, the drum 137 has a cylindrical shape having a diameter larger than the reel 138, and the drum 137 is rotatable, at a fixed position, in the circumferential direction about a drum shaft 147 that is axially supported by both the side plates 130 so as to be rotatable. Furthermore, as shown in FIG. 6, a driving motor 148 for rotating the drum 137 is disposed inside the drum 137, and the driving motor 148 is mounted to one of the side plates 130.

The reel 138 is mounted via a torque limiter (not shown) to a reel shaft 149 that is axially supported by both the side plates 130 so as to be rotatable, and the reel 138 is rotatable, at a fixed potion, about the reel shaft 149 in the circumferential direction.

A transmission mechanism (not shown) for transmitting rotational driving force from the drum 137 to the reel 138, and a rotation amount detection unit 151 (see FIG. 6) that detects a rotation amount of the drum 137 are disposed outside one of the side plates 130. The transmission mechanism has a one-way clutch which allows rotational driving force to be transmitted to the reel shaft 149 when the reel 138 is rotated in the direction in which the tape 136 is wound, and which does not allow rotational driving force to be transmitted to the reel shaft 149 when the reel 138 is rotated in the direction in which the tape 136 is unwound.

In a case where a banknote transported from the transport unit 16 is escrowed in the escrow unit 20, when the drum 137 is driven by the driving motor 148 to rotate in the direction in which the tape 136 is wound, the one-way clutch prevents transmission of rotational driving force to the reel 138, and the tape 136 to be wound onto the drum 137 is drawn from the reel 138 against the torque limiter. Meanwhile, in a case where a banknote escrowed in the escrow unit 20 is fed into the transport unit 16, when the drum 137 is driven by the driving motor 148 to rotate in an unwinding direction that is opposite to the direction in which the tape 136 is wound, rotational driving force is transmitted to the reel 138 via the one-way clutch, and the reel 138 rotates in the direction in which the tape 136 is wound. At this time, rotational driving force is transmitted via the torque limiter to the reel 138 such that a speed at which the tape 136 is wound onto the reel 138 is constantly higher than a speed at which the tape 136 is unwound from the drum 137, whereby the tape 136 can be wound onto the reel 138 without slackening the tape 136.

Furthermore, the diverging lever 139 is swingable by a lever shaft 153 acting as a fulcrum, and is driven by a stepper motor or a solenoid to advance into and retract from the transport unit 16. When the diverging lever 139 advances into the transport unit 16, a banknote transported by the transport unit 16 is taken into the outlet and inlet 135 and a banknote is fed through the outlet and inlet 135 into the transport unit 16. Meanwhile, when the diverging lever 139 retracts from the transport unit 16, a banknote transported in the transport unit 16 is allowed to pass.

Furthermore, the transport mechanism 140 has a pair of belts 155*a*, 155*b* and a plurality of pulleys 156*a*, 156*b*, 157*a*, 157*b*, 158 that extend the belts 155*a*, 155*b* along both sides of the fixed path 142 and both sides of the swing path 144 so as to rotate the belts 155*a*, 155*b* and that cause the surfaces of the belts 155*a*, 155*b* to contact each other. Among the plurality of pulleys 156*a*, 156*b*, 157*a*, 157*b*, 158, on both sides of the outlet and inlet 135, the pulleys 156*a*, 156*b* disposed on the fixed path 142 side are axially supported rotatably at a fixed position with respect to the side plates 130 on both sides. Furthermore, the pulleys 157*a*, 157*b* disposed on the swing path 144 side are axially supported by the guide member 141 so as to be rotatable, and swing together with the guide member 141. Furthermore, the pulley 158 disposed at the mid-portion of one belt 155*a* of the belts is axially and rotatably supported at a fixed position with respect to the side plates 130 on both sides, at a position closer to the drum 135 than the outlet and inlet 135.

The pulley shaft 159 of the pulley 158 acts as a fulcrum 141*a* of the guide member 141 that swings. A portion from the outlet and inlet 135 to the vicinity of the fulcrum 141*a* is formed as the fixed path 142, and a portion from the vicinity of the fulcrum 141*a* to the inside of the guide member 141 is formed as the swing path 144. Furthermore, in the fixed path 142, a fixed guide 160 for guiding a banknote is disposed.

A gear 161 (see FIG. 6) is mounted to the shaft of the pulley 156*b*, and the gear 161 meshes with a gear of a driving mechanism disposed in the body portion of the banknote handling machine 10, and rotational driving force is transmitted from the driving mechanism through the gear 161 to the belt 155*b*. Furthermore, rotational driving force is transmitted to the pulley shaft 159 of the pulley 158 through transmission means 162 from the gear 161. Thus, rotational driving force is transmitted to the belt 155*a*.

Furthermore, the guide member 141 includes a first guide member 164 and a second guide member 165, both sides of the first guide member 164 and both sides of the second guide member 165 are integrally connected by support members 166 (see FIG. 6), and both sides of the support members 166 are supported by the pulley shaft 159 so as to be swingable. That means, as described above, that the guide member 141 is supported so as to be swingable about the fulcrum 141*a*.

The inner faces of the first guide member 164 and the second guide member 165 oppose each other and serve as path surfaces, and the guide path 143 for guiding the tape 136 and a banknote is formed between the path surfaces. That is, the swing path 144 that swings about the fulcrum 141*a* is formed between the path surfaces.

As shown in FIG. 5, the shape of the guide member 141, that is, the shapes of the first guide member 164 and of the second guide member 165, and the shapes of the guide path 143 and the swing path 144 are formed so as to be curved along the maximum outer diameter portion (represented as reference character 137*p* in FIG. 5) in a maximum wound state where winding of the tape 136 and a banknote onto the drum 137 is maximum.

On the front-end side, of the first guide member 164, opposite to the fulcrum 141*a* side thereof, an extension portion 164*a* is extended so as to be elongated as compared to the front-end side portion, of the second guide member 165, opposite to the fulcrum 141*a* side portion. In the extension portion 164*a* of the first guide member 164, a contact roller 167 is disposed downstream of a contact point (represented as reference character S in FIG. 4 and FIG. 5) of the tape 136 wound on the drum 137 in the winding direction. The contact roller 167 directly contacts the drum 137 or a banknote wound on the drum 137 between the two tapes 136.

The contact roller 167 includes a first contact roller 167*a* and a second contact roller 167*b*. The first contact roller 167*a* contacts with a banknote wound on the drum 137 when the outer diameter is smaller than a predetermined outer diameter in a wound state in which a wound amount by which the tape 136 and banknotes are wound onto the drum 137 is less than a predetermined amount. The second contact roller 167*b* contacts with a banknote wound on the drum 137 when the outer diameter is greater than a predetermined outer diameter in a wound state in which a wound amount by which the tape 136 and banknotes are wound onto the drum 137 is greater than a predetermined amount. The first contact roller 167*a* and the second contact roller 167*b* contact with a portion downstream of the contact point S of the tape 136 wound on the drum 137 in the winding direction.

A spring 168 is extended between the second guide member 165 of the guide member 141 and the frame 132, and acts as biasing means that biases the guide member 141 towards the drum 137 such that the guide member 141 is close to the drum 137. Due to the bias of the spring 168, the contact roller 167 is constantly pressed toward the drum 137.

Therefore, the guide member 141 swings about the fulcrum 141*a* according to each of an operation of winding the tape 136 and a banknote onto the drum 137 and an operation of unwinding them from the drum 137.

A peeler 169 that peels, from the outer circumferential surface of the drum 137, a banknote that is unwound together with the tape 136 from the drum 137, so as to feed the banknote into the swing path 144, is swingably disposed, according to the position of each tape 136, on the front end side of the second guide member 165. The peeler 169 is biased by a spring or the like such that the peeler 169 swings toward the drum 137 and the front end portion of the peeler 169 constantly contacts with the tape 136.

As shown in FIG. 6, guide portions 170 that guide the banknote unwound from the drum 137 such that the both side portions of the banknote easily enter the inside of the swing path 144, are formed on both sides of the front end portion of the second guide member 165 by both side portions of the front end portion of the second guide member 165 being diagonally cut.

Furthermore, the pulleys 157*a*, 157*b* of the transport mechanism 140 are axially supported by the first guide member 164 and the second guide member 165, respectively, so as to be rotatable.

Furthermore, a guide roller 172 for guiding the tape 136 between the reel 138 and the swing path 144 is axially supported by the first guide member 164 so as to be rotatable. A tape guide 173 for guiding the tape 136 between the reel 138 and the guide roller 172 is mounted.

Furthermore, a tape end detection unit (not shown) that detects a limit of unwinding from the drum 137 and a limit of winding onto the drum 137 by detecting the non-transparent portions provided in one end region and the other end region, respectively, of the tape 136 is disposed in the first guide member 164. The tape end detection unit is disposed so as to correspond to each of the tapes 136.

Furthermore, a guide mechanism 184 that guides the tape 136 and a banknote between the guide roller 172 and the swing path 144 (guide path 143) is disposed near the front end portion of the second guide member 165 and near the end portion of the swing path 144 (guide path 143) that opposes the drum 137. The guide mechanisms 184 are separately disposed so as to correspond to the positions of the two tapes 136. Furthermore, the guide mechanisms 184 corresponding to the respective two tapes 136 each include a driving roller 185 and a transmission roller (not shown) disposed in the first guide member 164, and a guiding roller 188 disposed in the second guide member 165.

When the tape 136 is wound onto the drum 137 and unwound from the drum 137, driving force is transmitted, from the tape 136 which is moving, to the driving roller 185 that contacts with the second face 136*b* of the tape 136, and driving force is transmitted to the guiding roller 188 from the transmission roller that rotates integrally with the driving roller 185. Furthermore, the peeler 169 is detachably mounted so as to be rotatable.

Furthermore, the guide member 141 includes a banknote detection unit 195 that detects a banknote in a region, of the swing path 144, in which the banknote is transported together with the tape 136. The banknote detection unit 195 includes a photosensor and the like, and detects a banknote by light from the sensor being blocked during passing of the banknote.

Next, a structure of the shifting unit 19 provided in the banknote handling machine 10 of the present embodiment will be described in detail with reference to FIG. 7 to FIG. 9. FIG. 7 is a top view of the structure of the shifting unit 19 in the banknote handling machine 10 shown in FIG. 1. FIG. 8 is a side view of the shifting unit 19 shown in FIG. 7. FIG. 9 is a perspective view of the shifting unit 19 shown in FIG. 7 and FIG. 8. Furthermore, in FIG. 7 and FIG. 9, a banknote which is shifted by the shifting unit 19 is represented as reference character P.

The shifting unit 19 includes: a first fixed transport unit 220, the position of which is fixed, and which transports a paper sheet along a transport path 211; a plurality (for example, four) of slidable transport mechanisms 230 which are slidable along the width direction (the up-down direction in FIG. 7) of the transport path 211 and transport a banknote delivered from the first fixed transport unit 220; and a second fixed transport unit 250, the position of which is also fixed, and which transports the banknote delivered from the slidable transport mechanisms 230. Furthermore, an upstream-side transport unit 212 is disposed upstream of the first fixed transport unit 220 in the direction in which a banknote is transported. In FIG. 7, in the shifting unit 19, banknotes are transported rightward from the left side, one by one, along the transport path 211 that extends in the left-right direction in FIG. 7. At this time, the banknote is transported along the short edge direction.

As shown in FIG. 7 and FIG. 8, the upstream-side transport unit 212 includes an upper-side transport belt 214 that is extended by a plurality of upper-side rollers 215, and a lower-side transport belt 216 that is extended by a plurality of lower-side rollers 217. FIG. 7 shows a structure of the lower-side transport belt 216 obtained by the upper-side transport belt 214 and the upper-side rollers 215 being removed from the shifting unit 19. One of the plurality of lower-side rollers 217 has a driving motor mounted thereto. The lower-side rollers 217 are rotated by the driving motor, and the lower-side transport belt 216 thus circulates in the clockwise direction in FIG. 8. The upper-side transport belt 214 also rotates in conjunction with the lower-side transport belt 216. When the lower-side transport belt 216 is circulated in the clockwise direction in FIG. 8, the upper-side transport belt 214 is also circulated in the counterclockwise direction in FIG. 8. In the upstream-side transport unit 212, a banknote is transported rightward from the left side in FIG. 7 and FIG. 8 in a state where the banknote is nipped between the upper-side transport belt 214 and the lower-side transport belt 216. As shown in FIG. 7, the lower-side transport belt 216 is disposed such that a pair of left and right lower-side transport belts 216 are disposed along the width direction (the up-down direction in FIG. 7) of the transport path 211, and the upper-side transport belt 214 corresponding to the lower-side transport belt 216 is also disposed such that a pair of left and right upper-side transport belts 214 are disposed along the width direction of the transport path 211, which is not shown.

As shown in FIG. 7 and FIG. 8, the first fixed transport unit 220 includes an upper-side guide portion 222 and a lower-side guide portion 224 that are spaced from each other over a short distance in the up-down direction, and the transport path 211 in which a banknote is transported is formed between the upper-side guide portion 222 and the lower-side guide portion 224. As shown in FIG. 7, a pair of left and right driving rollers 226 are disposed in the lower-side guide portion 224 along the width direction of the transport path 211, and a pair of left and right driven rollers 228 are disposed in the upper-side guide portion 222 along the width direction of the transport path 211 so as to oppose the driving rollers 226, respectively. FIG. 7 shows the structure of the lower-side guide portion 224 and the driving rollers 226 obtained by the upper-side guide portion 222 and the driven rollers 228 being removed from the first fixed transport unit 220.

In the first fixed transport unit 220, a high friction member made of, for example, rubber is disposed on the outer circumferential surface of each driving roller 226, and the driving roller 226 is rotated in the clockwise direction in FIG. 8 through a drive shaft 229 by means of a roller driving unit 260 described below. Furthermore, a metallic member is disposed on the outer circumferential surface of each driven roller 228, and the driven roller 228 is disposed in the upper-side guide portion 222 so as to rotate in conjunction with the driving roller 226 in contact with the driving roller 226. A banknote being transported to a nip portion formed between the driving roller 226 and the driven roller 228 is transported along the transport path 211 in the rightward direction in FIG. 7 and FIG. 8.

Furthermore, similarly to the first fixed transport unit 220, the second fixed transport unit 250 also includes an upper-side guide portion 252 and a lower-side guide portion 254 that are spaced from each other over a short distance in the up-down direction, and the transport path 211 in which a banknote is transported is formed between the upper-side guide portion 252 and the lower-side guide portion 254. Furthermore, as shown in FIG. 7, a pair of left and right driving rollers 256 are disposed in the lower-side guide portion 254 along the width direction of the transport path 211, and a pair of left and right driven rollers 258 are disposed in the upper-side guide portion 252 along the width direction of the transport path 211 so as to oppose the driving rollers 256, respectively. FIG. 7 shows the structure of the lower-side guide portion 254 and the driving rollers 256 obtained by the upper-side guide portion 252 and the driven rollers 258 being removed from the second fixed transport unit 250.

In the second fixed transport unit 250, a high friction member made of, for example, rubber is disposed on the outer circumferential surface of each driving roller 256, and the driving roller 256 is rotated in the clockwise direction in FIG. 8 through a drive shaft 259 by means of the roller driving unit 260 described below. Furthermore, a metallic member is disposed on the outer circumferential surface of each driven roller 258, and the driven roller 258 is disposed in the upper-side guide portion 252 so as to rotate in conjunction with the driving roller 256 in contact with the driving roller 256. A banknote being transported to a nip portion formed between the driving roller 256 and the driven roller 258 is transported along the transport path 211 in the rightward direction in FIG. 7 and FIG. 8.

Furthermore, a plurality (for example, four) of the slidable transport mechanisms 230 are disposed in series along the banknote transporting direction between the first fixed transport unit 220 and the second fixed transport unit 250. Each of the slidable transport mechanisms 230 is slidable independently of the other slidable transport mechanisms 230, along the width direction (the up-down direction in FIG. 7) of the transport path 211. Thus, at whatever position in the width direction of the transport path 211 a banknote is positioned in the first fixed transport unit 220 upstream of the slidable transport mechanisms 230, by the banknote being moved along the width direction of the transport path 211 by the slidable transport mechanisms 230, a position, in the width direction of the transport path 211, of a paper sheet transported from the slidable transport mechanisms 230 to the second fixed transport unit 250 is shifted to a predetermined position.

As shown in FIG. 8, each slidable transport mechanism 230 includes an upper-side guide portion 232 and a lower-side guide portion 234 that are spaced from each other over a short distance in the up-down direction, and the transport path 211 in which a banknote is transported is formed between the upper-side guide portion 232 and the lower-side guide portion 234. The upper-side guide portion 232 and the lower-side guide portion 234 are connected to each other, and the upper-side guide portion 232 and the lower-side guide portion 234 can integrally slide along the width direction of the transport path 211. Furthermore, as shown in FIG. 7, a pair of left and right driving rollers 236 are disposed in the lower-side guide portion 234 along the width direction of the transport path 211, and a pair of left and right driven rollers 238 are disposed in the upper-side guide portion 232 along the width direction of the transport path 211 so as to oppose the driving rollers 236, respectively. FIG. 7 shows the structure of the lower-side guide portion 234 and the driving rollers 236 obtained by the upper-side guide portion 232 and the driven rollers 238 being removed from each of the slidable transport mechanisms 230.

In each of the slidable transport mechanisms 230, a high friction member made of, for example, rubber is disposed on the outer circumferential surface of each driving roller 236, and the driving roller 236 is rotated in the clockwise direction in FIG. 8 through a drive shaft 239 by means of the roller driving unit 260 described below. Furthermore, a metallic member is disposed on the outer circumferential surface of each driven roller 238, and the driven roller 238 is disposed in the upper-side guide portion 232 so as to rotate in conjunction with the driving roller 236 in contact with the driving roller 236. A banknote being transported to a nip portion formed between the driving roller 236 and the driven roller 238 is transported along the transport path 211 in the rightward direction in FIG. 7 and FIG. 8.

Furthermore, in the present embodiment, the driving rollers 226 of the first fixed transport unit 220, the driving rollers 236 of each of the slidable transport mechanisms 230, and the driving rollers 256 of the second fixed transport unit 250 are driven by the roller driving unit 260 that is a single driving system. Such a structure of the roller driving unit 260 will be described in detail with reference to FIG. 7 and FIG. 9. As shown in FIG. 7 and FIG. 9, gears 229*a*, 239*a*, 259*a* are disposed at the end portions of the drive shaft 229 of the driving roller 226 of the first fixed transport unit 220, the drive shaft 239 of the driving roller 236 of each slidable transport mechanism 230, and the drive shaft 259 of the driving roller 256 of the second fixed transport unit 250, respectively. Drive gears 264 are disposed between the gears 229*a*, 239*a*, and 259*a*. Furthermore, the gear 229*a* provided at the end portion of the drive shaft 229 of the driving roller 226 in the first fixed transport unit 220 is disposed so as to mesh with a drive gear 262. A drive gear 261 is disposed so as to mesh with the drive gear 262. By the drive gear 261 being rotated by a non-illustrated driving motor such as a stepper motor, the gear 229*a* is rotated through the drive gear 262, and the rotational driving force is transmitted to gears 239*a* and gear 259*a* through the drive gears 264. Thus, the drive shafts 229, 239, 259 integrally rotate and the driving rollers 226, 236, 256 also integrally rotate.

As shown in FIG. 7 and FIG. 9, each of the drive gears 264 extends along the width direction (that is, the longitudinal direction of each drive shaft 239) of the transport path 211. Therefore, when the upper-side guide portion 232 and the lower-side guide portion 234 of each slidable transport mechanism 230 slide along the width direction of the transport path 211, and the drive shafts 239 of the driving rollers 236 also move along the width direction of the transport path 211, the gears 239*a* and the drive gears 264 are not disengaged from each other. Thus, when the drive shafts 239 of the driving rollers 236 are moved along the width direction of the transport path 211, the roller driving unit 260 allows the driving rollers 226, 236, 256 to integrally rotate.

As shown in FIG. 7, in the shifting unit 19, an inlet-side paper sheet detection sensor 270 is disposed upstream of the first fixed transport unit 220 in the banknote transporting direction, and an outlet-side paper sheet detection sensor (not shown) is disposed downstream of the second fixed transport unit 250 in the banknote transporting direction. The inlet-side paper sheet detection sensor 270 detects the length in the width direction, a position in the width direction of the transport path 211, a skew angle (degree of skew), and the like for a banknote transported along the transport path 211 by the upstream-side transport unit 212. The detection information of the banknote detected by the inlet-side paper sheet detection sensor 270 is transmitted to a control unit 50 described below. Furthermore, the outlet-side paper sheet detection sensor detects the length in the width direction, a position in the width direction of the transport path 211, a skew angle (degree of skew), and the like for a banknote that has been transported after shifted to a predetermined position in the width direction of the transport path 211 by each of the slidable transport mechanisms 230. The detection information of the banknote detected by the outlet-side paper sheet detection sensor is transmitted to the control unit 50 described below. The control unit 50 determines, on the basis of the detection information, of the paper sheet, transmitted from the outlet-side paper sheet detection sensor, whether or not the banknote has been correctly shifted to the predetermined position in the width direction of the transport path 211 by each of the slidable transport mechanisms 230.

As shown in FIG. 7, in the shifting unit 19, an inlet-side transport time detection sensor 274 is disposed upstream of the first fixed transport unit 220 and downstream of the inlet-side paper sheet detection sensor 270 in the banknote transporting direction. Furthermore, an outlet-side transport time detection sensor (not shown) is disposed downstream of the second fixed transport unit 250 and upstream of the outlet-side paper sheet detection sensor in the banknote transporting direction. The inlet-side transport time detection sensor 274 detects a time immediately before a banknote is transported to the first fixed transport unit 220.

Furthermore, the outlet-side transport time detection sensor detects a time when a banknote is transported from the second fixed transport unit 250 after a position, of the banknote, in the width direction of the transport path 211 has been shifted to a predetermined position by the slidable transport mechanisms 230. The detection information of the banknote from each of the inlet-side transport time detection sensor 274 and the outlet-side transport time detection sensor is transmitted to the control unit 50 described below.

In a case where a banknote has been transported by the transport unit 16 into the shifting unit 19 having such a structure, the banknote is transported rightward from the left side in FIG. 7 and FIG. 8 by the shifting unit 19. Specifically, the inlet-side paper sheet detection sensor 270 firstly detects the length in the width direction, a position in the width direction of the transport path 211, a skew angle (degree of skew), and the like for the banknote. The detection information from the inlet-side paper sheet detection sensor 270 is transmitted to the control unit 50 described below. The control unit 50 calculates a shift distance for each of the slidable transport mechanisms 230, on the basis of: a position, in the width direction of the transport path 211, of the banknote which has not been transported yet to the slidable transport mechanisms 230, the position having been detected by the inlet-side paper sheet detection sensor 270; and a predetermined position, of the banknote in the width direction of the transport path 211, which has been preset. Thereafter, the banknote is transported along the transport path 211 by the upstream-side transport unit 212, and is delivered to the first fixed transport unit 220. The banknote is delivered from the first fixed transport unit 220 to the slidable transport mechanisms 230, and is transported in the rightward direction in FIG. 7 and FIG. 8, in a sequential manner, by the slidable transport mechanisms 230, and is thereafter delivered from the slidable transport mechanisms 230 to the second fixed transport unit 250. When the banknote is transported in the rightward direction in FIG. 7 and FIG. 8 in a sequential manner by the slidable transport mechanisms 230, the upper-side guide portions 232 and the lower-side guide portions 234 of the slidable transport mechanisms 230 slide along the width direction of the transport path 211. Therefore, at whatever position in the width direction of the transport path 211 the banknote is positioned in the first fixed transport unit 220 on the upstream side, by the banknote being moved along the width direction of the transport path 211 by the slidable transport mechanisms 230, the position, in the width direction of the transport path 211, of the banknote transported from the slidable transport mechanisms 230 to the second fixed transport unit 250 has been shifted to a predetermined position.

Furthermore, as shown in FIG. 2, the banknote handling machine 10 of the present embodiment includes the control unit 50 that controls each of the components of the banknote handling machine 10. More specifically, the banknote feeding mechanism 12*a* disposed in the inlet unit 12, the transport unit 16, the recognition unit 18, the shifting unit 19, the escrow unit 20 (specifically, the driving motor 148 of the escrow unit 20), the banknote feeding mechanism 32 disposed in each of the banknote storages 30, the banknote feeding mechanism 42 disposed in the banknote storage cassette 40 mounted in the housing 11, and the like are connected to the control unit 50 so as to be in communication. A signal associated with a result of recognition of a banknote by the recognition unit 18 is transmitted to the control unit 50, and the control unit 50 transmits an instruction signal to each of the components of the banknote handling machine 10, to control operations of the components.

Furthermore, as shown in FIG. 2, an operation display unit 52, a memory unit 54, and a communication interface unit 56 are connected to the control unit 50 so as to be in communication. The operation display unit 52 is implemented as, for example, a touch panel provided on, for example, the upper surface of the housing 11, and information about, for example, a state of handling such as banknote depositing in the banknote handling machine 10, or an inventory amount of banknotes stored in each banknote storage 30 or the banknote storage cassette 40 is displayed on the operation display unit 52. Furthermore, information about a state in which banknotes are stored in the escrow unit 20, each banknote storage 30, the banknote storage cassette 40, or the like may be displayed on the operation display unit 52. Specifically, information indicating whether or not a so-called conical shape is formed by a plurality of hybrid banknotes which have been wound onto the outer circumferential surface of the drum 137 by the tapes 136 in the escrow unit 20 may be displayed on the operation display unit 52. Furthermore, in a case where, as described below, storing and feeding units 60 (see FIG. 13) in each of which banknotes are wound onto the outer circumferential surface of a drum by a tape, are provided, instead of the banknote storages 30 in which a plurality of banknotes are stored in a stacked state, as a storage unit in which banknotes are stored, information indicating whether or not a so-called conical shape is formed by a plurality of hybrid banknotes which have been wound onto the outer circumferential surface of the drum by the tape in each storing and feeding unit 60, may be displayed on the operation display unit 52. Furthermore, an operator can provide the control unit 50 with various instructions by operating the operation display unit 52.

Information about the handling history such as banknote deposit in the banknote handling machine 10, and an inventory amount of banknotes stored in each banknote storage 30 or the banknote storage cassette 40, is stored in the memory unit 54. Furthermore, information about a state in which banknotes are stored in the escrow unit 20, each banknote storage 30, the banknote storage cassette 40, or the like, may also be stored in the memory unit 54. Furthermore, the control unit 50 can transmit a signal to and receive a signal from an external device (specifically, for example, higher-ranking terminal) provided separately from the banknote handling machine 10 of the present embodiment, through the communication interface unit 56.

The control unit 50 described above is disposed in the housing 11 of the banknote handling machine 10 so as to control the components of the banknote handling machine 10. However, in a case where the escrow unit 20 is used alone as a banknote storing and feeding apparatus, a control unit that controls the components of the escrow unit 20 may be disposed in the escrow unit 20.

Furthermore, the banknote handling machine 10 of the present embodiment can handle a hybrid banknote having paper and a polymer film combined with each other, in addition to ordinary banknotes formed only from paper. Such a structure of the hybrid banknote will be described with reference to FIG. 3. As shown in FIG. 3, a hybrid banknote (represented as reference character P in FIG. 3) is formed by a polymer film portion $P_2$ that linearly extends along the short edge direction of the banknote being sandwiched between paired paper portions $P_1$. In some countries and regions, such a hybrid banknote is regarded as a normal banknote. Therefore, in a case where a hybrid banknote as shown in FIG. 3 is recognized by the recognition unit 18, the control unit 50 determines that such a hybrid banknote is a normal banknote.

The polymer film portion $P_2$ of such a hybrid banknote has a higher stiffness than the paper portions $P_1$, and, furthermore, the polymer film portion $P_2$ has a greater thickness than the paper portions $P_1$. Therefore, in a conventional art, when the hybrid banknote is wound, by the belt-shaped tape 136, onto the outer circumferential surface of the drum 137 in the escrow unit 20, a problem arises that a force with which the tape 136 presses the hybrid banknote against the outer circumferential surface of the drum 137 is reduced as compared to a case where a banknote formed only from paper is wound, by the belt-shaped tape 136, onto the outer circumferential surface of the drum 137. Furthermore, as shown in FIG. 6, in a case where the two tapes 136 are provided in alignment along the axial direction of the drum 137, a pressing force of the tape 136 closest to the polymer film portion $P_2$ of the hybrid banknote becomes lower than a pressing force of the tape 136 farthest from the polymer film portion $P_2$. In this case, since the tape 136 portion which is closest to the polymer film portion $P_2$ of the hybrid banknote expands outward of the drum 137 when a plurality of hybrid banknotes have been wound onto the outer circumferential surface of the drum 137, a so-called conical shape is formed by the plurality of hybrid banknotes that have been wound, by each tape 136, onto the outer circumferential surface of the drum 137, as viewed in the direction orthogonal to the drum shaft 147. The positions of the hybrid banknotes stored on the drum 137 may become displaced in the axial direction of the drum 137. Furthermore, in conventional arts, in a case where, after the hybrid banknotes as shown in FIG. 3 are stored in each banknote storage 30 or the banknote storage cassette 40, the banknotes stored in the banknote storage 30 or the banknote storage cassette 40 are fed by a pair of left and right feed rollers of the banknote feeding mechanism 32 or 42 provided in the banknote storage 30 or the banknote storage cassette 40, when the paper portion $P_1$ of the hybrid banknote contacts with one of the feed rollers and the polymer film portion $P_2$ contacts with the other of the feed rollers, a coefficient of friction of the paper portion $P_1$ relative to the feed roller and a coefficient of friction of the polymer film portion $P_2$ relative to the feed roller are different. Therefore, the hybrid banknote fed into the transport unit 16 by the pair of feed rollers may become skewed.

In order to address this, in the present embodiment, for a hybrid banknote to be escrowed in the escrow unit 20, the shifting unit 19 shifts the hybrid banknote in the width direction of the hybrid banknote before the hybrid banknote is transported to the escrow unit 20, such that the position, in the width direction, of the polymer film portion $P_2$ of the hybrid banknote at least partially overlaps the position, in the width direction, of the tape 136 in the escrow unit 20. Thus, the polymer film portion $P_2$ of the hybrid banknote can be pressed directly onto the outer circumferential surface of the drum 137 by the tape 136 in the escrow unit 20. Therefore, the hybrid banknotes can be appropriately stored on the drum 137 of the escrow unit 20. Such technical matter will be described below in detail. Furthermore, in the present embodiment, for a hybrid banknote to be stored in each banknote storage 30 or the banknote storage cassette 40, the shifting unit 19 shifts the hybrid banknote in the width direction of the hybrid banknote before the hybrid banknote is transported to the banknote storage 30 or the banknote storage cassette 40, such that the position, in the width direction, of the polymer film portion $P_2$ of the hybrid banknote is displaced from the position, in the width direction, of the pair of feed rollers of the banknote feeding mechanism 32 or 42 in the banknote storage 30 or the banknote storage cassette 40. Thus, the paper portions $P_1$ of the hybrid banknote contact the pair of left and right feed rollers when the banknote stored in the banknote storage 30 or the banknote storage cassette 40 is fed by the banknote feeding mechanism 32 or 42 of the banknote storage 30 or the banknote storage cassette 40, whereby the banknote fed into the transport unit 16 is prevented from being skewed. Such technical matter will be also described below in detail.

Next, an operation of the banknote handling machine 10 having such a structure will be described. The operation of the banknote handling machine 10 as described below is performed by the components of the banknote handling machine 10 being controlled by the control unit 50.

Firstly, an operation performed when the banknote handling machine 10 performs banknote depositing will be described. An operator places a plurality of banknotes in the inlet unit 12 in a stacked state. Thereafter, when the control unit 50 is provided with an instruction to start depositing through the operation display unit 52, the banknotes placed in the inlet unit 12 are fed one by one into the housing 11 by the banknote feeding mechanism 12*a*, and are transported one by one by the transport unit 16. Recognition of denomination, authentication, recognition of face/back, recognition of fitness, recognition of old/new version, recognition of transported states, and the like for each banknote transported by the transport unit 16 are performed by the recognition unit 18. A banknote recognized by the recognition unit 18 as not being a normal banknote, that is, a rejected note is transported through the shifting unit 19 and thereafter transported into the discharge unit 14 by the transport unit 16 and stacked in the discharge unit 14. Thereafter, the operator manually takes out the rejected notes stacked in the discharge unit 14 from the housing 11, and is allowed to place banknotes again in the inlet unit 12. Meanwhile, a banknote recognized as a normal banknote by the recognition unit 18 is transported through the shifting unit 19, and thereafter transported from the transport unit 16 into the escrow unit 20, and is escrowed in the escrow unit 20. At this time, in a case where the banknote recognized by the recognition unit 18 is a hybrid banknote as shown in FIG. 3, the shifting unit 19 shifts the hybrid banknote in the width direction of the hybrid banknote before the hybrid banknote is transported to the escrow unit 20, such that the position, in the width direction, of the polymer film portion $P_2$ of the hybrid banknote at least partially overlaps the position, in the width direction, of the tape 136 in the escrow unit 20. Such an operation performed by the shifting unit 19 will be described with reference to FIG. 10.

Figure 10:
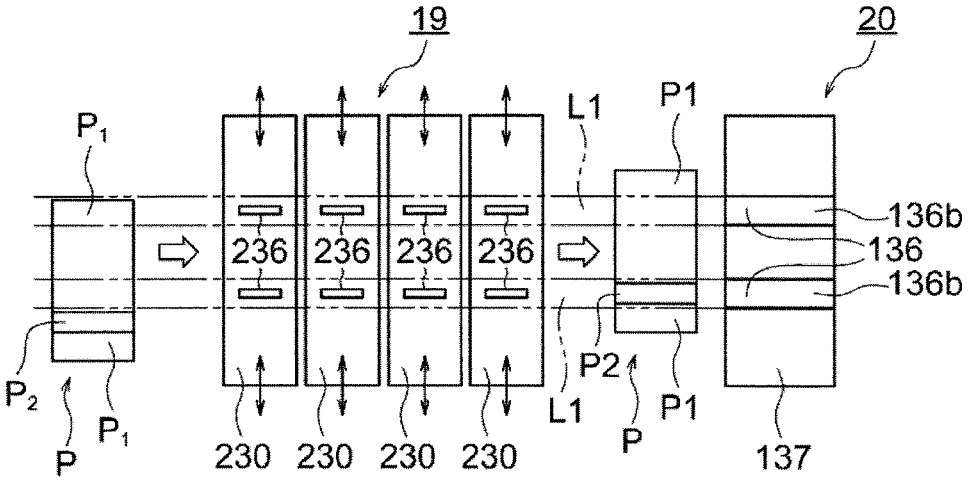
FIG. 10 illustrates an operation of shifting a banknote by the shifting unit shown in FIG. 7 to FIG. 9 such that a position, in the width direction, of a polymer film portion of a hybrid banknote at least partially overlaps a position, in the width direction, of a tape in the escrow unit, in the banknote handling machine shown in FIG. 1.

FIG. 10 shows an operation for a hybrid banknote that is transported through the shifting unit 19 into the escrow unit 20 after being recognized by the recognition unit 18. In FIG. 10, the direction in which the hybrid banknote is transported by the transport unit 16 is the rightward direction. Furthermore, the positions, in the transport path of the transport unit 16, corresponding to the positions, in the width direction, of the tapes 136 in the escrow unit 20 are each represented as reference character L1.

In the present embodiment, a position, in the width direction, of the hybrid banknote transported by the transport unit 16 is detected by the recognition unit 18. On the basis of the position, in the width direction, of the polymer film portion $P_2$ of the hybrid banknote recognized by the recognition unit 18, the shifting unit 19 shifts the banknote in the width direction. Specifically, in the example shown in FIG. 10, the position, in the width direction, of the polymer film portion $P_2$ of the hybrid banknote (that is, a hybrid banknote that has not yet been transported to the shifting unit 19) immediately after recognized by the recognition unit 18 is displaced from the positions, in the width direction, of the tapes 136 in the escrow unit 20 (see the leftmost hybrid banknote in FIG. 10). In this case, the shifting unit 19 shifts the hybrid banknote in the width direction thereof (specifically, the hybrid banknote is shifted so as to move upward in FIG. 10), and the position, in the width direction, of the polymer film portion $P_2$ of the hybrid banknote that has been transported through the shifting unit 19 at least partially overlaps the positions, in the width direction, of the tapes 136 in the escrow unit 20 (see the hybrid banknote positioned on the right side of the shifting unit 19 in FIG. 10). Thus, in the present embodiment, for the hybrid banknote to be escrowed in the escrow unit 20, the shifting unit 19 shifts the hybrid banknote in the width direction of the hybrid banknote before the hybrid banknote is transported to the escrow unit 20, such that the position, in the width direction, of the polymer film portion $P_2$ of the hybrid banknote at least partially overlaps the positions, in the width direction, of the tapes 136 in the escrow unit 20. Thus, in the escrow unit 20, the polymer film portion $P_2$ of the hybrid banknote can be pressed directly onto the outer circumferential surface of the drum 137, by the tape 136 indicated on the lower side in FIG. 10, among the pair of tapes 136. Therefore, the hybrid banknote can be appropriately stored on the drum 137 in the escrow unit 20.

When all the banknotes placed in the inlet unit 12 are fed into the housing 11 and transported into the escrow unit 20 or the discharge unit 14, a message for requesting the operator to confirm the deposit is displayed on the operation display unit 52. Thereafter, when the operator uses the operation display unit 52 to provide the control unit 50 with an instruction for confirming the deposit, the banknotes are fed one by one from the escrow unit 20 into the transport unit 16, and transported through the recognition unit 18 and the shifting unit 19 by the transport unit 16 and the banknotes are thereafter transported into the banknote storages 30 according to their denominations. Thus, a series of operations for depositing the banknotes by the banknote handling machine 10 are completed. Meanwhile, when the operator uses the operation display unit 52 to provide the control unit 50 with an instruction for return, instead of providing the control unit 50 with an instruction for confirming the deposit, the banknotes are fed one by one from the escrow unit 20 into the transport unit 16, and transported to the discharge unit 14 by the transport unit 16. Thus, the operator can take out the returned banknotes from the discharge unit 14 to the outside of the housing 11.

In the present embodiment, in a case where, when the banknotes fed from the escrow unit 20 are transported into the banknote storages 30, the banknotes fed from the escrow unit 20 are hybrid banknotes as shown in FIG. 3, the shifting unit 19 shifts the hybrid banknotes in the width direction of the hybrid banknote before the hybrid banknotes are transported into the banknote storages 30, such that the position, in the width direction, of the polymer film portion $P_2$ of each hybrid banknote is displaced from the positions, in the width direction, of a pair of left and right feed rollers 32*a* (see FIG. 11) of the banknote feeding mechanism 32 in each banknote storage 30. Such an operation performed by the shifting unit 19 will be described with reference to FIG. 11.

Figure 11:
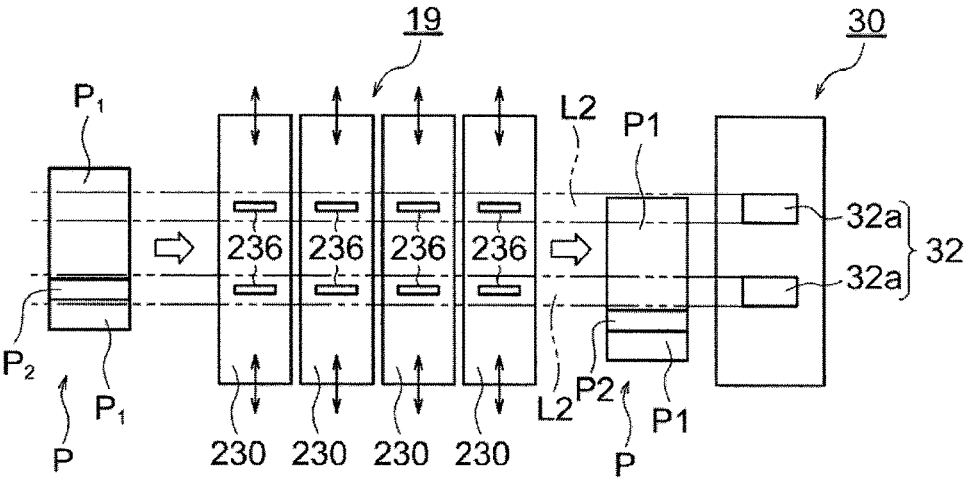
FIG. 11 illustrates an operation of shifting a banknote by the shifting unit shown in FIG. 7 to FIG. 9 such that a position, in the width direction, of a polymer film portion of a hybrid banknote is displaced from a position, in the width direction, of a feed roller in a banknote storage, in the banknote handling machine shown in FIG. 1.

FIG. 11 shows an operation in which the hybrid banknote is fed from the escrow unit 20 into the transport unit 16 and recognized by the recognition unit 18, and thereafter transported through the shifting unit 19 into the banknote storage 30. In FIG. 11, a direction in which the hybrid banknote is transported by the transport unit 16 is the rightward direction. Furthermore, the positions, in the transport path of the transport unit 16, corresponding to the positions, in the width direction, of the feed rollers 32*a* of the banknote feeding mechanism 32 in the banknote storage 30 are each represented as reference character L2.

In the present embodiment, the recognition unit 18 detects a position, in the width direction, of the hybrid banknote fed from the escrow unit 20 into the transport unit 16. Based on the position, in the width direction, of the polymer film portion P2 of the hybrid banknote, which is recognized by the recognition unit 18, the shifting unit 19 shifts the banknote in the width direction. Specifically, in the example shown in FIG. 11, the position, in the width direction, of the polymer film portion $P_2$ of the hybrid banknote (that is, hybrid banknote that has not yet been transported to the shifting unit 19) immediately after being recognized by the recognition unit 18 at least partially overlaps the positions, in the width direction, of the feed rollers 32*a* of the banknote feeding mechanism 32 provided in each banknote storage 30 (see the leftmost hybrid banknote in FIG. 11). In this case, the shifting unit 19 shifts the hybrid banknote in the width direction thereof (specifically, the hybrid banknote is shifted so as to move downward in FIG. 11), and the position, in the width direction, of the polymer film portion $P_2$ of the hybrid banknote that has been transported through the shifting unit 19 is displaced from the positions, in the width direction, of the feed rollers 32*a* of the banknote feeding mechanism 32 provided in each banknote storage 30 (see the hybrid banknote positioned on the right side of the shifting unit 19 in FIG. 11). Thus, in the present embodiment, for the hybrid banknotes to be stored in the banknote storages 30, the shifting unit 19 shifts each hybrid banknote in the width direction of the hybrid banknote before the hybrid banknote is transported into the banknote storage 30, such that the position, in the width direction, of the polymer film portion $P_2$ of the hybrid banknote is displaced from the positions, in the width direction, of the feed rollers 32*a* of the banknote feeding mechanism 32. Thus, in each banknote storage 30, when the banknote stored in the banknote storage 30 is fed by the banknote feeding mechanism 32, the paper portions $P_1$ of the hybrid banknote contact with the pair of left and right feed rollers 32*a*. Therefore, the banknote fed into the transport unit 16 can be prevented from becoming skewed.

Next, an operation performed when the banknote handling machine 10 performs banknote dispensing will be described. When an operator uses the operation display unit 52 to provide the control unit 50 with an instruction for starting dispensing, the number of banknotes that are to be dispensed from the banknote storage 30 that correspond to a denomination of the banknotes to be dispensed are fed one by one from the banknote storage 30 into the transport unit 16 by the banknote feeding mechanism 32, transported into the discharge unit 14 by the transport unit 16, and stored in the discharge unit 14 in a stacked state. At this time, the banknotes fed into the transport unit 16 from the banknote storage 30 are transported to the recognition unit 18 by the transport unit 16, and the denomination, a transported state, and the like are recognized by the recognition unit 18. The banknote recognized by the recognition unit 18 is transported through the shifting unit 19 into the discharge unit 14 by the transport unit 16. When all the banknotes to be dispensed, for each denomination, are fed from the banknote storages 30 and transported into the discharge unit 14, the operator can take out the banknotes to be dispensed, from the discharge unit 14, to the outside of the housing 11. Thus, a series of operation for dispensing banknotes is completed.

In another modification, the shifting unit 19 and the recognition unit 18 may be disposed in opposite order. In this case, when the banknotes are dispensed, the shifting unit 19 may operate so as to shift, along the width direction of the banknotes, the banknotes recognized by the recognition unit 18, such that positions of the lateral edge portions of the plurality of banknotes to be stacked in the discharge unit 14 are slightly displaced, or the banknotes are displaced in units of categories. Thus, after the operator takes out the dispensed banknotes from the discharge unit 14 to the outside of the housing 11, the operator can easily count the plurality of stacked banknotes with her/his hands. Furthermore, in this case, where the banknotes are being deposited, when the banknotes inserted into the housing 11 through the inlet unit 12 are transported into the escrow unit 20 by the transport unit 16, the recognition unit 18 may recognize the banknotes without shifting the banknotes by the shifting unit 19, and, when the banknotes escrowed in the escrow unit 20 are transported into the banknote storages 30 or the banknote storage cassette 40, the banknotes transported by the transport unit 18 may be shifted in the width direction by the shifting unit 19.

Figure 12:
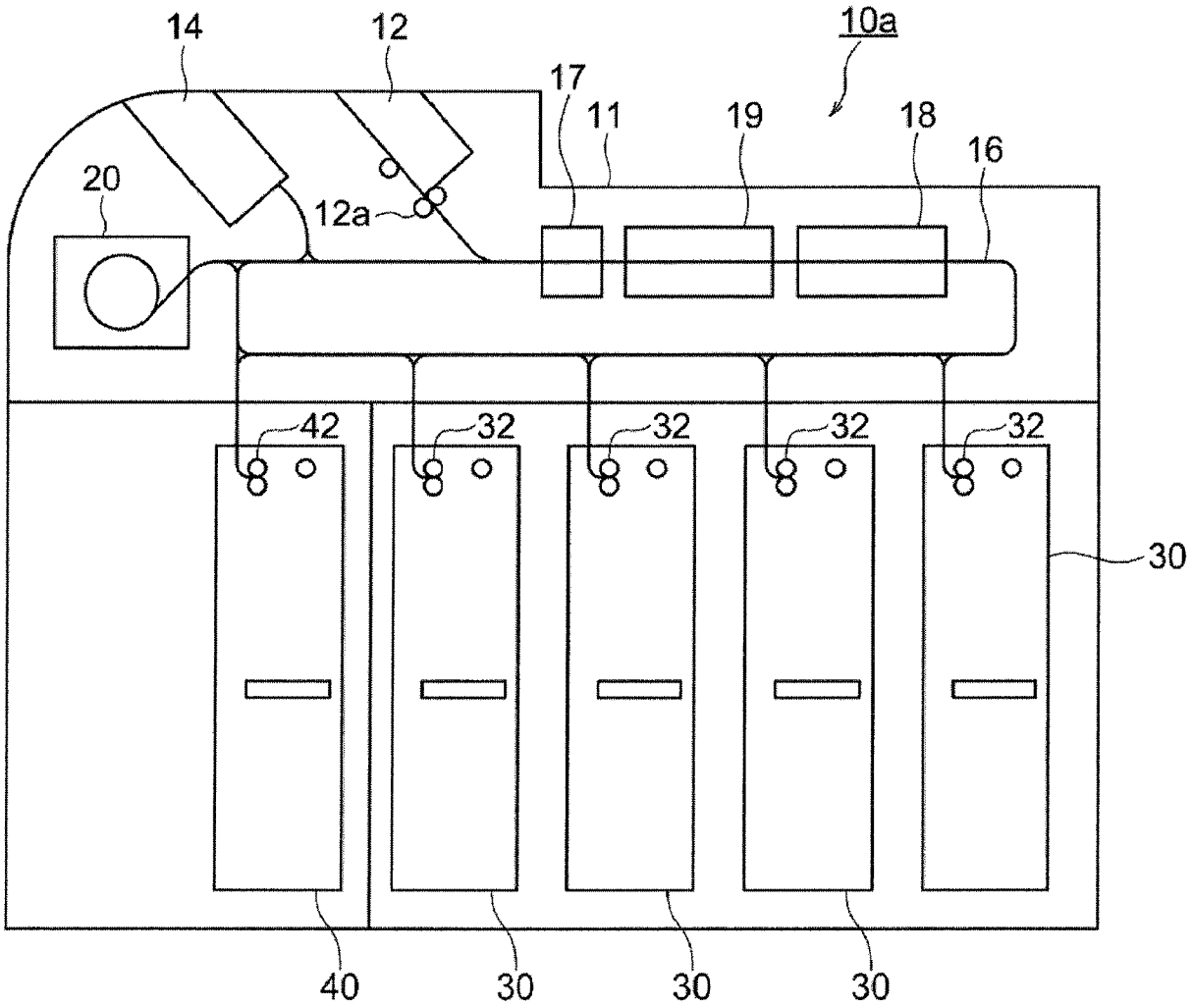
FIG. 12 schematically illustrates a structure of a banknote handling machine according to modification.

Furthermore, in a case where the shifting unit 19 and the recognition unit 18 are disposed in the opposite order, a feature portion detection unit that detects a position, in the width direction, of the polymer film portion $P_2$ of the hybrid banknote may be disposed upstream of the shifting unit 19 in the direction in which the banknote is transported by the transport unit 16. A structure of a banknote handling machine according to this modification will be described with reference to FIG. 12. In a banknote handling machine 10*a* according to a modification as shown in FIG. 12, the shifting unit 19 and the recognition unit 18 are disposed in the order opposite to the order thereof in the banknote handling machine 10 shown in FIG. 1, and, furthermore, a feature portion detection unit 17 that detects a position, in the width direction, of the polymer film portion $P_2$ of the hybrid banknote is disposed upstream of the shifting unit 19 in the direction in which the banknote is transported by the transport unit 16. A plurality of photosensors aligned along the width direction of the transport path for the banknote in the transport unit 16 are used, for example, as the feature portion detection unit 17. Thus, in a case where, in the transport unit 16, the feature portion detection unit 17 is disposed so as to be closer to the inlet unit 12 than the recognition unit 18 is, the feature portion detection unit 17 can detect a position, in the width direction, of the polymer film portion $P_2$ of the hybrid banknote before the hybrid banknote is shifted by the shifting unit 19, whereas the recognition unit 18 can detect a position, in the width direction, of the polymer film portion $P_2$ of the hybrid banknote after the hybrid banknote is shifted by the shifting unit 19, whereby a shift distance over which the hybrid banknote is shifted in the width direction by the shifting unit 19 can be calculated. If the shift distance over which the hybrid banknote is shifted in the width direction by the shifting unit 19 is not the desired distance, the shifting unit 19 may again shift the banknote transported by the transport unit 18, in the width direction, when the banknote escrowed in the escrow unit 20 is transported into the banknote storage 30 or the banknote storage cassette 40. Furthermore, in the banknote handling machine 10*a* according to the modification shown in FIG. 12, the feature portion detection unit 17 and the recognition unit 18 may be disposed in opposite order. Also in this case, a shift distance over which the banknote is shifted in the width direction by the shifting unit 19 can be calculated on the basis of the result of recognition by the recognition unit 18 and the result of detection by the feature portion detection unit 17.

Further, in the present embodiment, when banknotes are dispensed, the shifting unit 19 may shift the transported banknotes along the width direction of the banknotes regardless of the result of recognition by the recognition unit 18. For example, the shifting unit 19 may shift the banknotes transported by the transport unit 16, along the width direction thereof, such that the lateral edge portions of a plurality of banknotes to be stacked in the discharge unit 14 are aligned.

Further, in another mode of dispensing banknotes in the present embodiment, the shifting unit 19 may shift banknotes recognized by the recognition unit 18, along the width direction of the banknotes, such that the lateral edge portions of the dispensed banknotes to be stacked in the discharge unit 14 are aligned in units of denominations. That is, among the dispensed banknotes stacked in the discharge unit 14, positions of the lateral edge portions of banknotes of one denomination and positions of the lateral edge portion of banknotes of another denomination are slightly misaligned. Thus, an operator can easily sort the dispensed banknotes for each denomination after the operator takes out the dispensed banknotes from the discharge unit 14 to the outside of the housing 11.

Further, in still another mode of dispensing banknotes in the present embodiment, in a case where a plurality of hybrid banknotes as shown in FIG. 3 are stacked in the discharge unit 14, the shifting unit 19 may shift banknotes recognized by the recognition unit 18, along the width direction of the banknotes, such that the polymer film portions $P_2$ of the hybrid banknotes do not overlap each other at the same position. In a case where the dispensed banknotes are stacked in the discharge unit 14, when a plurality of hybrid banknotes as shown in FIG. 3 are stacked in the discharge unit 14, if the polymer film portions $P_2$ overlap each other at the same position, the thickness of a portion in which the polymer film portions $P_2$ overlap each other, becomes greater than the thickness of another portion of the hybrid banknotes, and the hybrid banknotes placed in the discharge unit 14 in a stacked state may collapse from a predetermined stacked state. Meanwhile, in a case where the shifting unit 19 shifts the hybrid banknotes recognized by the recognition unit 18, along the width direction thereof, such that the polymer film portions $P_2$ of the hybrid banknotes do not overlap each other at the same position, the dispensed banknotes can be appropriately stacked in the discharge unit 14.

Next, an operation performed when the banknote handling machine 10 performs collecting of banknotes will be described. When an operator uses the operation display unit 52 to provide the control unit 50 with an instruction for starting banknote collection, the number of banknotes that are to be collected from the banknote storage 30 and that correspond to a denomination of the banknotes to be collected, are fed one by one from the banknote storage 30 into the transport unit 16 by the banknote feeding mechanism 32. The banknotes are transported by the transport unit 16 into the banknote storage cassette 40 mounted in the housing 11, and are stored in the banknote storage cassette 40 in a stacked state. At this time, the banknotes fed from the banknote storage 30 into the transport unit 16 are transported into the recognition unit 18 by the transport unit 16, and the denomination, a transported state, and the like of each banknote are recognized by the recognition unit 18. Furthermore, the banknotes recognized by the recognition unit 18 are transported through the shifting unit 19, and thereafter transported into the banknote storage cassette 40 by the transport unit 16. All the banknotes to be collected for each denomination are fed from the banknote storage 30, and transported into the banknote storage cassette 40. An operator thereafter takes out the banknote storage cassette 40 from the housing 11, whereby the operator can collect the banknotes stored in the banknote storage cassette 40 together with the banknote storage cassette 40. Thus, a series of operations for collecting banknotes are completed.

In the present embodiment, in the collection of banknotes, in a case where the banknotes fed from the banknote storages 30 are transported into the banknote storage cassette 40, when the banknotes fed from the banknote storages 30 are hybrid banknotes as shown in FIG. 3, the shifting unit 19 may shift each hybrid banknote in the width direction of the hybrid banknote before the hybrid banknote is transported into the banknote storage cassette 40, such that the position, in the width direction, of the polymer film portion $P_2$ of the hybrid banknote is displaced from the positions, in the width direction, of a pair of left and right feed rollers of the banknote feeding mechanism 42 of the banknote storage cassette 40. In this case, when the banknotes stored in the banknote storage cassette 40 are fed by the banknote feeding mechanism 42 in the banknote storage cassette 40, the paper portions $P_1$ of each hybrid banknote contact the pair of left and right feed rollers of the banknote feeding mechanism 42, whereby the banknotes fed from the banknote storage cassette 40 are prevented from becoming skewed.

Furthermore, in another mode of the present embodiment, in the collection of banknotes, in a case where a plurality of hybrid banknotes as shown in FIG. 3 are stored in the banknote storage cassette 40, the shifting unit 19 may shift banknotes recognized by the recognition unit 18, along the width direction of the banknotes, such that the polymer film portions $P_2$ of the hybrid banknotes do not overlap each other at the same position. When banknotes are stored in the banknote storage cassette 40 in a stacked state, if the polymer film portions $P_2$ of the hybrid banknotes as shown in FIG. 3 overlap each other at the same position, the combined thickness of the overlapping polymer film portions $P_2$ becomes greater than the combined thickness of another portion of the hybrid banknotes, whereby the height of the banknotes stored in the banknote storage cassette 40 in a stacked state becomes different between the left side and the right side, and consequently an erroneous feed may occur when banknotes are fed by the banknote feeding mechanism 42. Meanwhile, in a case where the shifting unit 19 shifts banknotes recognized by the recognition unit 18 along the width direction of the banknotes, such that the polymer film portions $P_2$ of the hybrid banknotes do not overlap each other at the same position, the banknotes can be appropriately stored in the banknote storage cassette 40.

In the banknote handling machine 10, according to the present embodiment, having the above-described structure, and the banknote handling method performed by the banknote handling machine 10, the shifting unit 19 provided in the transport unit 16 shifts banknotes transported by the transport unit 16, in the width direction, according to a position, of a specific member (specifically, the tape 136 in the escrow unit 20, a pair of feed rollers of the banknote feeding mechanism 32, 42 provided in the banknote storage 30 or the banknote storage cassette 40) in a storage unit (specifically, the escrow unit 20, each banknote storage 30, or the banknote storage cassette 40), in the width direction orthogonal to the direction in which the banknotes are transported. Thus, the shifting unit 19 shifts, in the width direction, banknotes transported by the transport unit 16 according to a position, of the specific member in the storage unit, in the width direction orthogonal to the direction in which the banknotes are transported, and the shifted banknotes are stored in the storage unit, whereby the hybrid banknotes (specific banknotes) can be appropriately stored in the storage unit, and the hybrid banknotes can be appropriately fed from the storage unit.

Furthermore, in the banknote handling machine 10 of the present embodiment and the banknote handling method performed by the banknote handling machine 10, as described above, the recognition unit 18 that detects a predetermined feature portion (specifically, the polymer film portion $P_2$ of the hybrid banknote) of the banknote transported by the transport unit 16 is disposed in the transport unit 16, and the shifting unit 19 shifts the banknote in the width direction on the basis of the position, in the width direction, of the predetermined feature position of the banknote recognized by the recognition unit 18.

Specifically, in a case where the above-described storage unit is the escrow unit 20, the escrow unit 20 has, as the above-described specific member, the belt-shaped tape 136 (winding member) by which a banknote is wound onto the outer circumferential surface of the drum 137 (rotating member for winding a paper sheet). The shifting unit 19 shifts the banknote in the width direction such that the position, in the width direction, of the predetermined feature portion (specifically, the polymer film portion $P_2$ of the hybrid banknote) of the banknote to be escrowed in the escrow unit 20 at least partially overlaps the position, in the width direction, of the tape 136 in the escrow unit 20. Thus, the polymer film portion $P_2$ of the hybrid banknote can be pressed directly onto the outer circumferential surface of the drum 137 by the tape 136 in the escrow unit 20, whereby the hybrid banknotes can be appropriately stored on the drum 137 of the escrow unit 20.

Furthermore, in a case where the above-described storage unit is the banknote storage 30 or the banknote storage cassette 40, the banknote storage 30 or the banknote storage cassette 40 has, as the above-described specific member, the banknote feeding mechanism 32, 42 (specifically, a pair of feed rollers) for feeding the banknotes stored in a stacked state from the banknote storage 30 or the banknote storage cassette 40. The shifting unit 19 shifts the banknotes in the width direction such that the position, in the width direction, of the predetermined feature portion (specifically, the polymer film portion $P_2$ of the hybrid banknote) of each banknote to be stored in the banknote storage 30 or the banknote storage cassette 40 is displaced from positions, in the width direction, of the paired feed rollers of the banknote feeding mechanism 32, 42 provided in the banknote storage 30 or the banknote storage cassette 40. Thus, in the banknote storage 30 or the banknote storage cassette 40, when a banknote stored in the banknote storage 30 or the banknote storage cassette 40 is fed by the banknote feeding mechanism 32, 42, the paper portions $P_1$ of each hybrid banknote contact the pair of left and right feed rollers such that the banknotes fed into the transport unit 16 are prevented from becoming skewed.

Further, in the banknote handling machine 10 of the present embodiment, as described above, the recognition unit 18 and the shifting unit 19 are connected by the linear transport path in the transport unit 16. Thus, positions, in the width direction, of the polymer film portions $P_2$ or the like of the hybrid banknotes are recognized by the recognition unit 18, and the hybrid banknotes are thereafter transported along the linear transport path into the shifting unit 19. Therefore, while the hybrid banknotes are transported to the shifting unit 19, the banknotes can be prohibited from being displaced in the width direction thereof, whereby the hybrid banknotes can be accurately shifted by the shifting unit 19 along the width direction of the banknotes.

Furthermore, in the banknote handling machine 10 of the present embodiment and the banknote handling method performed by the banknote handling machine 10, as described above, the predetermined feature portion of a banknote is a portion (specifically, the polymer film portion P2), of the banknote, formed from a material other than paper.

The banknote handling machine 10 of the present embodiment and the banknote handling method performed by the banknote handling machine 10 are not limited to the above-described modes, and various modifications can be made.

For example, the escrow unit of the present embodiment may not be limited to the escrow unit 20 having the two tapes 136 as shown in FIG. 4 to FIG. 6. As the escrow unit of the present embodiment, an escrow unit in which banknotes are wound onto the outer circumferential surface of the drum by using three or more tapes aligned in parallel, or an escrow unit in which banknotes are wound onto the outer circumferential surface of the drum by using only one tape, may be used.

Furthermore, in a case where the principle of the present invention that a specific banknote such as a hybrid banknote is shifted along the width direction thereof by the shifting unit 19 before the banknote is transported to the escrow unit 20, the banknote storage 30, the banknote storage cassette 40, or the like, is applied to the banknote handling machine 10 or the banknote handling method, the specific banknote to be handled by the banknote handling machine 10 may be a banknote from which a security thread has been removed, a torn note, a transparent polymer banknote (specifically, a transparent sheet, such as an OHP (overhead projector) sheet, on which a pattern of a banknote is printed), a banknote on which a cellophane tape is adhered, a hard, stiff, and inflexible banknote, a banknote having an embossed characters or the like on a surface, a banknote with a part of different thickness or the like, as well as a hybrid banknote that includes a polymer film portion. In the banknote handling machine 10 of the present embodiment, before such a banknote is transported to the escrow unit 20, or the banknote storage 30, or the banknote storage cassette 40, or the like, the shifting unit 19 may shift the banknote transported by the transport unit 16 in the width direction of the banknote, on the basis of a position, in the width direction, of the tape 136 in the escrow unit 20 or the position, in the width direction, of the banknote feeding mechanism 32 of the banknote storage 30 or the like. Also in this case, the specific banknotes described above can be appropriately stored in the storage unit that includes the escrow unit 20, the banknote storages 30, the banknote storage cassette 40, and the like, or the specific banknotes can be appropriately fed from the storage unit.

Furthermore, in a case where a banknote to be handed by the banknote handling machine 10 is a banknote having a transparent polymer portion, the shifting unit 19 may shift the banknote recognized by the recognition unit 18, along the width direction thereof, such that the transparent polymer portion does not overlap a light sensor disposed in the transport path of the transport unit 16. The transparent polymer portion allows light to be transmitted therethrough, and cannot be detected by the light sensor. Therefore, due to the shift performed by the shifting unit 19, a paper portion, of a banknote, which can be detected by the light sensor, may be caused to overlap the light sensor. Further, in a case where a remaining banknote detection sensor is provided inside the banknote storage 30 or the banknote storage cassette 40, the shifting unit 19 may shift a banknote in the width direction of the banknote before the banknote is stored in the banknote storage 30 or the banknote storage cassette 40, such that the transparent polymer portion of the banknote to be stored in the banknote storage 30 or the banknote storage cassette 40 does not overlap the remaining banknote detection sensor.

Figure 13:
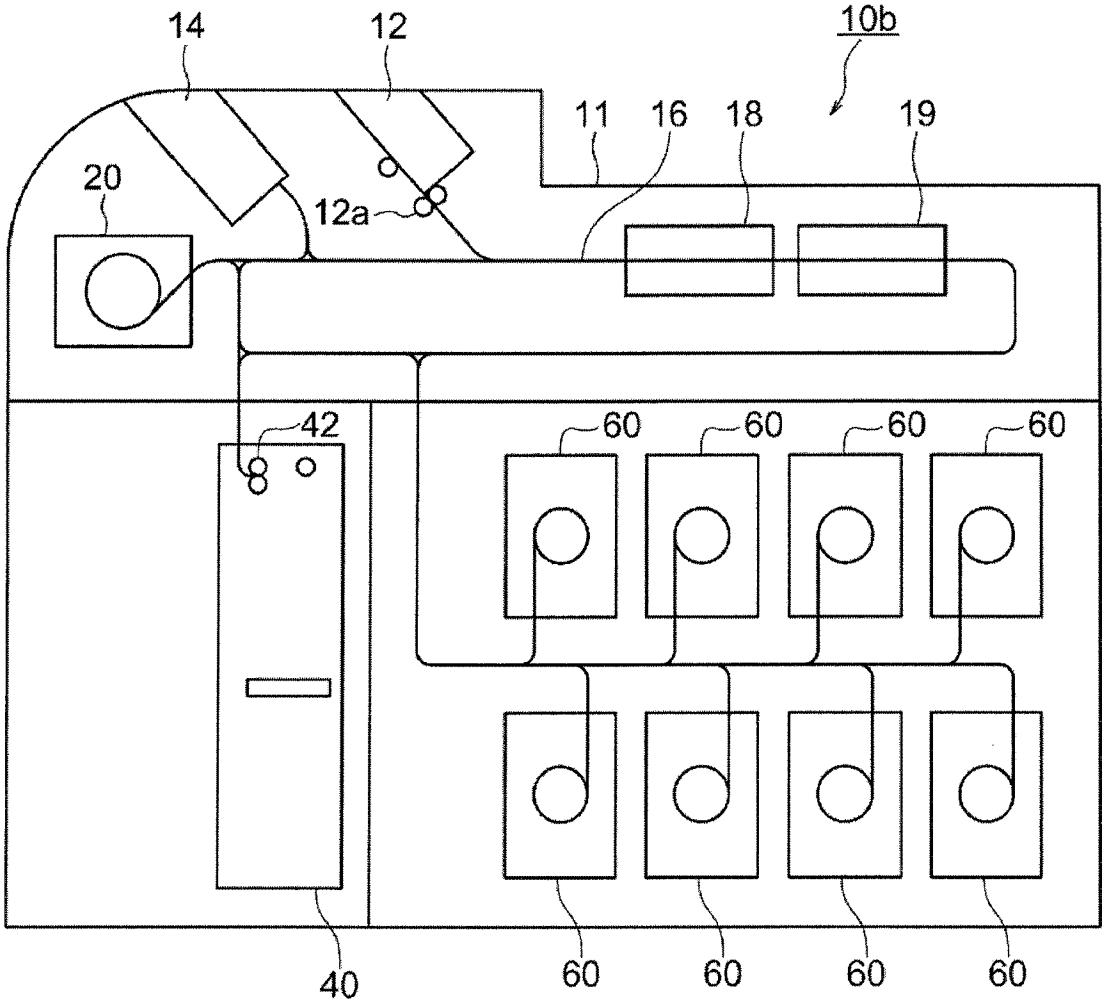
FIG. 13 schematically illustrates a structure of a banknote handling machine according to another modification.

Furthermore, as the banknote handling machine of the present embodiment, the banknote handling machine having the structure as shown in FIG. 13 may be used. A banknote handling machine 10*b* according to a modification as shown in FIG. 13 has, as a storage unit that stores banknotes, a storing and feeding unit 60 in which a banknote is wound onto the outer circumferential surface of a drum by using a tape, instead of the banknote storage 30 in which a plurality of banknotes is stored in a stacked state. Specifically, in the banknote handling machine 10*b* according to the modification, as shown in FIG. 13, a plurality (for example, eight) of storing and feeding units 60 are connected to the transport unit 16, and banknotes are transported from the transport unit 16 into the storing and feeding units 60 according to denomination, and stored in the storing and feeding units 60. Furthermore, the banknotes stored in each storing and feeding unit 60 are fed one by one from the storing and feeding unit 60 into the transport unit 16. In the banknote handling machine 10*b* having such a structure, the structures of the storing and feeding units 60 are almost the same as the structure of the escrow unit 20 shown in FIG. 4 to FIG. 6.

In the banknote handling machine 10*b* according to the modification shown in FIG. 13, when banknotes are deposited, the banknotes inserted from the inlet unit 12 into the housing 11 are escrowed in the escrow unit 20, and are thereafter fed one by one from the escrow unit 20 into the transport unit 16. The banknotes are transported through the recognition unit 18 and the shifting unit 19 by the transport unit 16, and are thereafter transported into the storing and feeding units 60 according to denomination. In a case where the banknote recognized by the recognition unit 18 is a hybrid banknote as shown in FIG. 3, the shifting unit 19 shifts the hybrid banknote in the width direction of the hybrid banknote before the hybrid banknote is transported to the storing and feeding unit 60, such that the position, in the width direction, of the polymer film portion $P_2$ of the hybrid banknote at least partially overlaps the position, in the width direction, of a tape (not shown) in the storing and feeding unit 60. Thus, in the storing and feeding unit 60, the polymer film portion $P_2$ of the hybrid banknote can be pressed directly onto the outer circumferential surface of a drum (not shown) by the tape. Therefore, in each storing and feeding units 60, the hybrid banknotes can be appropriately stored on the drum.

Furthermore, according to the present embodiment, in the banknote handling machine 10 as shown in FIG. 1, the banknote handling machine 10*a* as shown in FIG. 12, and the banknote handling machine 10*b* as shown in FIG. 13, the escrow unit 20 may not be provided. In this case, when depositing banknotes, the banknotes are fed from the inlet unit 12 into the housing 11 by the banknote feeding mechanism 12*a*, recognized by the recognition unit 18, and transported through the shifting unit 19, and thereafter transported directly to the banknote storages 30 or the storing and feeding units 60. Also in this case, for banknotes to be stored in a storage unit such as the banknote storage 30 or the storing and feeding unit 60, the shifting unit 19 shifts, in the width direction, the banknote transported by the transport unit 16, on the basis of the position, in the width direction, of the specific member (specifically, the pair of feed rollers 32*a* of the banknote feeding mechanism 32 disposed in the banknote storage 30, or the tape in the storing and feeding unit 60, and the like) in the storage unit. The principle by which the shifting unit 19 shifts the banknote is the same as the principle for a case where banknotes fed from the escrow unit 20 are stored in the banknote storage 30, the storing and feeding unit 60, or the like in the above-described banknote handling machine 10 as shown in FIG. 1, the above-described banknote handling machine 10*a* as shown in FIG. 12 or the above-described banknote handling machine 10*b* as shown in FIG. 13.

Furthermore, for the banknotes to be stored in a storage unit such as the banknote storage 30 or the storing and feeding unit 60, the shifting unit 19 may shift, in the width direction, a banknote transported by the transport unit 16, on the basis of the inlet width of each banknote storage 30 or each storing and feeding unit 60. Specifically, the shifting unit 19 shifts a banknote in the width direction such that the banknote to be stored is transported to the center, in the inlet width, of the banknote storage 30 or the storing and feeding unit 60.

Furthermore, in a banknote handling machine according to still another modification, three or more shifting units having the same structure as the shifting unit 19 described above may be provided. In this case, among the three or more shifting units, one shifting unit shifts a banknote along the width direction thereof before the banknote is transported to the escrow unit after the banknote is fed from the inlet unit into the housing in banknote depositing, and another shifting unit shifts a banknote along the width direction thereof before the banknote is transported to the banknote storage or the storing and feeding unit after the banknote is fed from the escrow unit in banknote depositing. Furthermore, still another shifting unit shifts a banknote along the width direction thereof before the banknote is transported to the discharge unit and after the banknote is fed from the banknote storage or the storing and feeding unit in banknote dispensing.

Figure 14:
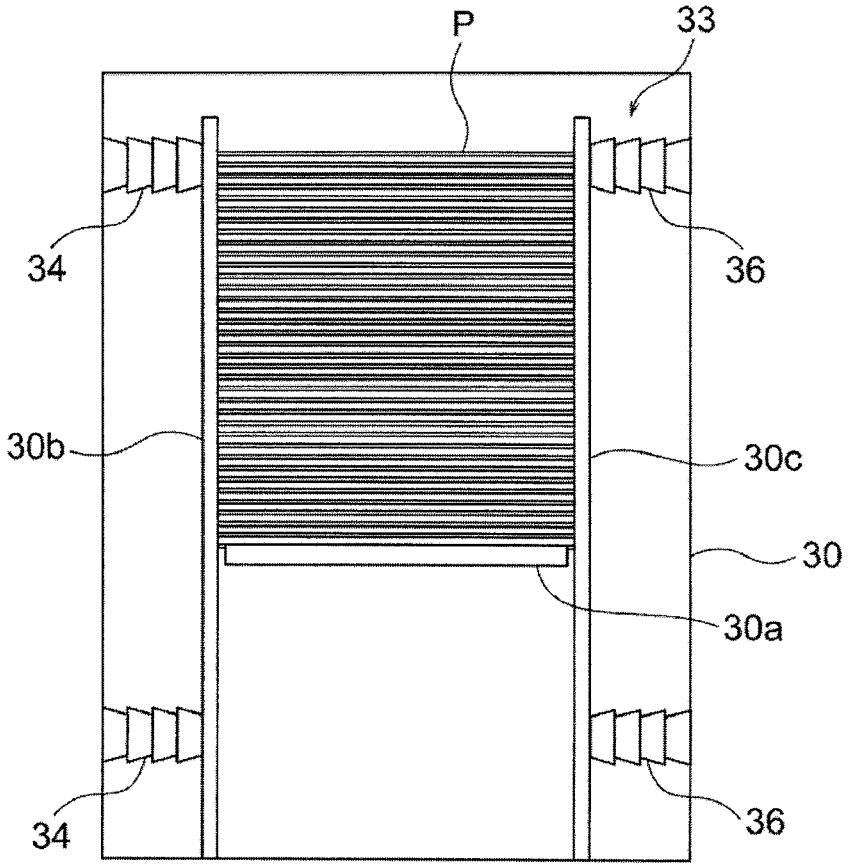
FIG. 14(*a*) is a side view of a structure of a banknote storage having a storage space shifting mechanism provided therein, and FIG. 14(*b*) is a top view of a structure of a banknote feeding mechanism provided in the banknote storage shown in FIG. 14(*a*).
Figure 14:
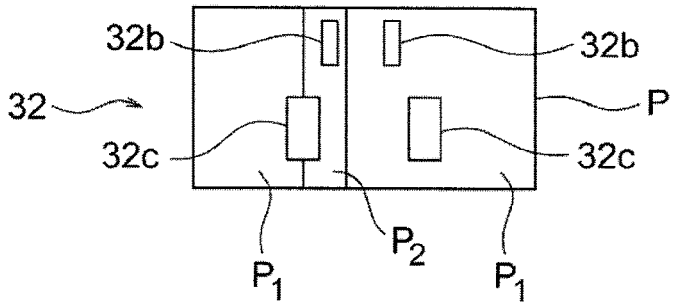
Figure 15:
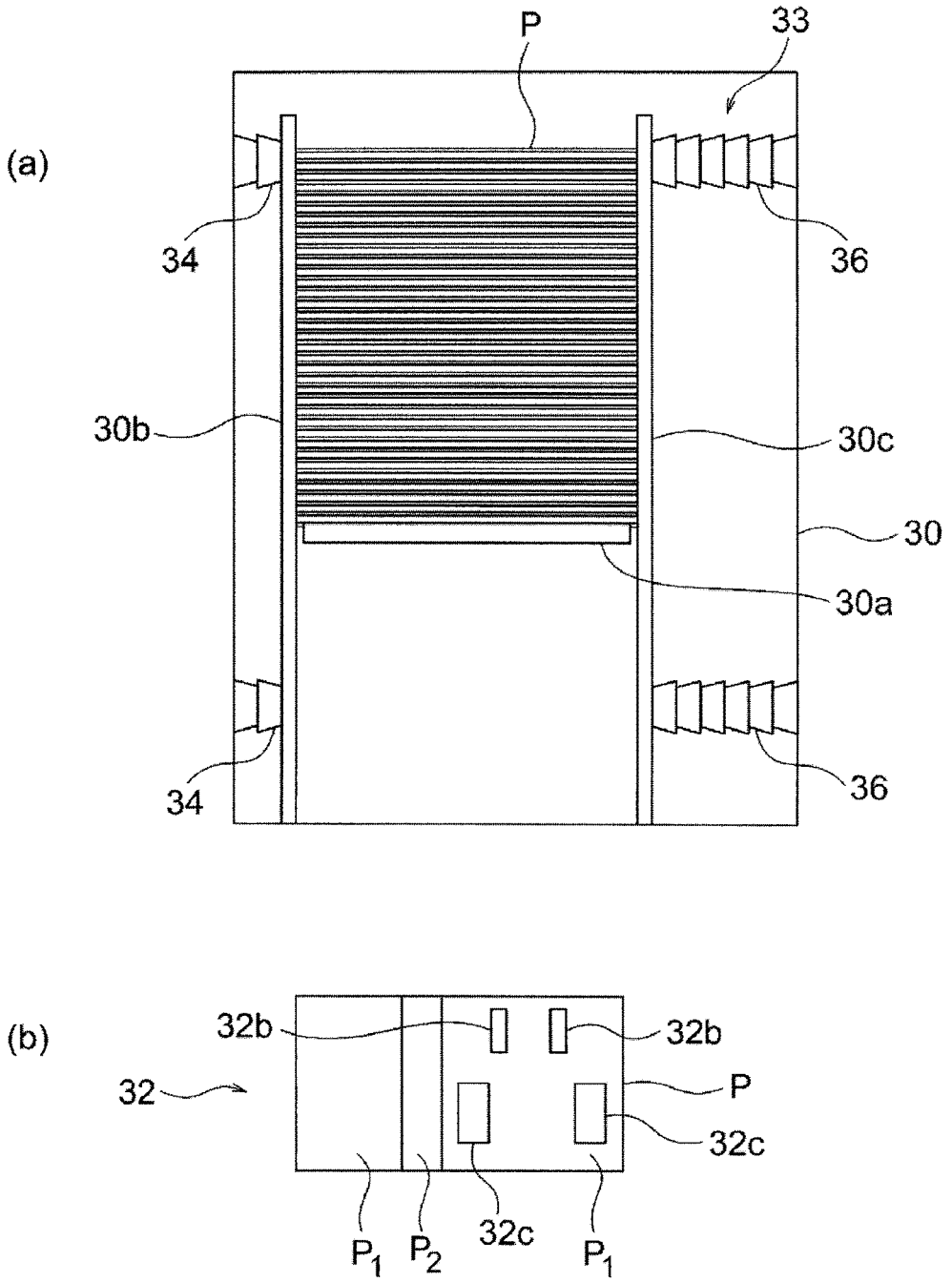
FIG. 15(*a*) is a side view of a structure of the banknote storage shown in (a) of FIG. 14 in which a banknote storage space is shifted leftward by the storage space shifting mechanism, and FIG. 15(*b*) is a top view of a structure of the banknote feeding mechanism in the case of the banknote storage space being shifted leftward by the storage space shifting mechanism.
Figure 16:
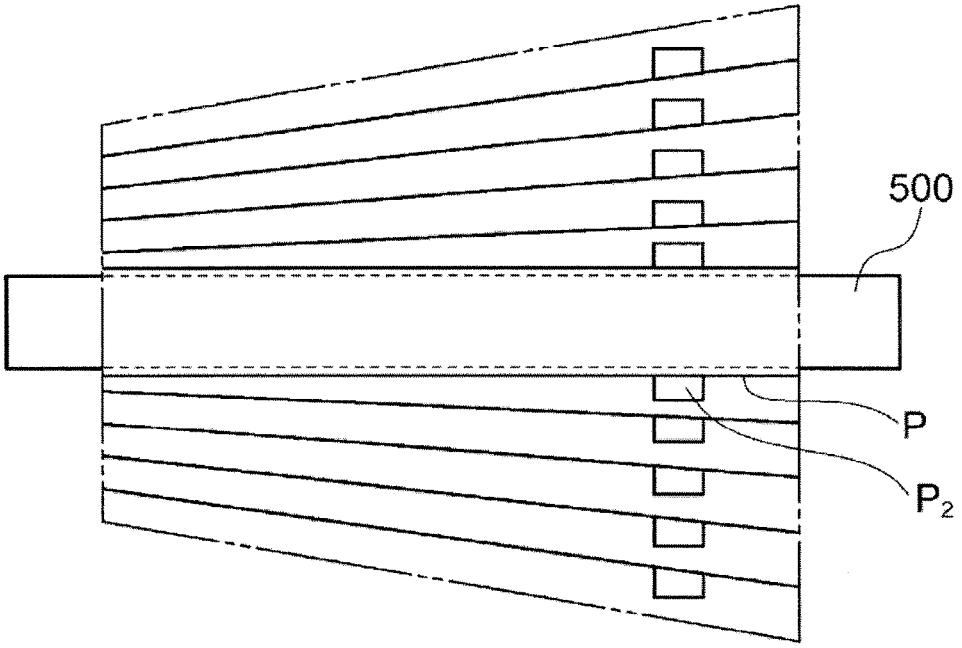
FIG. 16 illustrates a state where a conical shape is formed by a plurality of hybrid banknotes having been wound, by tapes, on an outer circumferential surface of a rotating member, in a conventional art.

Furthermore, as described above, after the hybrid banknotes as shown in FIG. 3 are stored in the banknote storage 30 or the banknote storage cassette 40, in a case where the banknotes stored in the banknote storage 30 or the banknote storage cassette 40 are fed by the pair of left and right feed rollers 32*a* of the banknote feeding mechanism 32, 42 provided in the banknote storage 30 or the banknote storage cassette 40, when the paper portion $P_1$ of the hybrid banknote contacts with one of the feed rollers 32*a*, and the polymer film portion $P_2$ contacts with the other of the feed rollers 32*a*, since a coefficient of friction of the paper portion $P_1$ relative to the feed roller 32*a* and a coefficient of friction of the polymer film portion $P_2$ relative to the feed roller 32*a* are different, the hybrid banknote fed by the pair of feed rollers 32*a* into the transport unit 16 may become skewed. In order to solve such a problem, a storage space shifting mechanism 33 for shifting a banknote storage space in the width direction may be provided in each banknote storage 30 or the banknote storage cassette 40, and the banknote storage space may be shifted in the width direction of the banknote in the banknote storage 30 or the banknote storage cassette 40 by such a storage space shifting mechanism. The storage space shifting mechanism 33 for shifting the banknote storage space in the width direction in the banknote storage 30 will be described in detail with reference to FIG. 14 and FIG. 15. FIG. 14(*a*) is a side view of a structure of the banknote storages 30 having the storage space shifting mechanism 33 provided therein. FIG. 14(*b*) is a top view of a structure of the banknote feeding mechanism 32 provided in the banknote storage 30 shown in FIG. 14(*a*). Furthermore, FIG. 15(*a*) is a side view of a structure of a banknote storage space which is shifted leftward by the storage space shifting mechanism 33 in the banknote storage 30 shown in FIG. 14(*a*). FIG. 15(*b*) is a top view of a structure of the banknote feeding mechanism 32 in the case of the banknote storage space being shifted leftward by the storage space shifting mechanism 33.

In the banknote storage 30 as shown in FIG. 14(*a*), banknotes are stored in a stacked state on a stage 30*a* that is movable in the ascending and descending direction, and a pair of left and right regulation plates 30*b*, 30*c* are provided for preventing the banknotes stacked on the stage 30*a* from being displaced in the width direction. A banknote storage space is formed above the stage 30*a* between the paired left and right regulation plates 30*b* and 30*c*. Furthermore, two extendable and contractable members 34 are provided between one regulation plate 30*b* among the pair of left and right regulation plates 30*b*, 30*c*, and one inner side wall (side wall on the left side in (a) of FIG. 14) of the banknote storage 30. Two extendable and contractable members 36 are provided between the other regulation plate 30*c* thereamong and the other inner side wall (side wall on the right side in (a) of FIG. 14) of the banknote storage 30. When each of the extendable and contractable members 34 contracts and each of the extendable and contractable members 36 extends, the regulation plates 30*b*, 30*c* are moved in the leftward direction in (a) of FIG. 14 and the positions thereof are shifted as shown in (a) of FIG. 15, whereby the banknote storage space is shifted leftward. Meanwhile, when each of the extendable and contractable members 34 extends and each of the extendable and contractable members 36 contracts, the regulation plates 30*b*, 30*c* are moved in the rightward direction in (a) of FIG. 14, whereby the banknote storage space is shifted rightward. Thus, the storage space shifting mechanism 33 that shifts the banknote storage space in the direction orthogonal to the direction in which banknotes are fed by the banknote feeding mechanism 32 is formed by the pair of left and right regulation plates 30*b*, 30*c* and the extendable and contractable members 34, 36 being used in combination.

As shown in FIG. 14(*b*), the banknote feeding mechanism 32 provided in the banknote storage 30 as shown in FIG. 14(*a*) includes: the pair of left and right feed rollers 32*a* described above; a pair of gate rollers 32*b* that are provided so as to oppose the feed rollers 32*a* and form a gate portion between the feed rollers 32*a* and the gate rollers 32*b*; and a kicker roller 32*c* for kicking the uppermost banknote among a plurality of banknotes stacked on the stage 30*a* toward the feed rollers 32*a*. In a case where the regulation plates 30*b*, 30*c* are positioned as shown in FIG. 14(*a*), when the banknotes stored in the banknote storage 30 are fed by the pair of left and right feed rollers 32*a* of the banknote feeding mechanism 32, the paper portion $P_1$ of the hybrid banknote passes between one of the feed rollers 32*a* and the gate roller 32*b* and the polymer film portion $P_2$ passes between the other of the feed rollers 32*a* and the gate roller 32*b* as shown in FIG. 14(*b*), and a coefficient of friction of the paper portion $P_1$ relative to the feed roller 32*a* and a coefficient of friction of the polymer film portion $P_2$ relative to the feed roller 32*a* are different, whereby the hybrid banknote fed into the transport unit 16 by the pair of feed rollers 32*a* may become skewed. Therefore, as shown in FIG. 15(*a*), each of the extendable and contractable members 34 is contracted and each of the extendable and contractable members 36 is extended, whereby the regulation plates 30*b*, 30*c* are moved in the leftward direction in FIG. 14(*a*) to shift the banknote storage space leftward. Thus, when the banknotes stored in the banknote storage 30 are fed by the pair of left and right feed rollers 32*a* of the banknote feeding mechanism 32, only the paper portion $P_1$ of the hybrid banknote passes between the pair of left and right feed rollers 32*a* and the gate rollers 32*b* as shown in (b) of FIG. 15. Therefore, the hybrid banknote fed into the transport unit 16 by the pair of feed rollers 32*a* can be prevented from being skewed.

Thus, in a case where the banknote storage 30 has the storage space shifting mechanism 33 provided therein, when the hybrid banknotes stored in the banknote storage 30 are fed into the transport unit 16 by the banknote feeding mechanism 32, the banknote storage space is shifted to a desired position by the storage space shifting mechanism 33, whereby the hybrid banknotes fed into the transport unit 16 can be prevented from becoming skewed. Furthermore, a storage space shifting mechanism having the same structure as the storage space shifting mechanism 33 as described above may be provided in the banknote storage cassette 40.

Furthermore, the paper sheet handling machine of the present invention and the paper sheet handling method performed by the paper sheet handling machine are not limited to the banknote handling machine 10 for performing various handling operations such as banknote depositing as described above, and the banknote handling method performed by the banknote handling machine 10. For the paper sheet handling machine and the paper sheet handling method according to the present invention, a machine and a method in which paper sheets such as checks and gift coupons other than banknotes can be handled, may be used.

The invention claimed is:

1. A sheet handling machine comprising:

an inlet unit through which a sheet is inserted from an outside of a housing into an inside thereof;

a transport unit configured to transport the sheet inserted in the inlet unit;

a recognition unit disposed on the transport unit and configured to recognize the sheet being transported by the transport unit;

a storage unit configured to store the sheet recognized by the recognition unit; and a shifting unit provided in the transport unit, wherein when the sheet is recognized by the recognition unit as a hybrid sheet having a first portion that includes paper and a second portion that includes predetermined material other than the paper, the shifting unit shifts the hybrid sheet being transported by the transport unit, in a width direction orthogonal to a direction in which the sheet is transported, according to a position, in the width direction, of a specific member in the storage unit.

2. The sheet handling machine according to claim 1, wherein the recognition unit detects the second portion of the hybrid sheet being transported by the transport unit, and the shifting unit shifts the hybrid sheet in the width direction, on the basis of a position, in the width direction, of the second portion recognized in the hybrid sheet by the recognition unit.

3. The sheet handling machine according to claim 2, wherein the storage unit has, as the specific member, a belt-shaped winding member for winding the sheet recognized by the recognition unit onto an outer circumferential surface of a rotating member for winding the sheet, and the shifting unit shifts the sheet in the width direction such that a position, in the width direction, of the second portion of the hybrid sheet at least partially overlaps a position, in the width direction, of the winding member in the storage unit.

4. The sheet handling machine according to claim 2, wherein the storage unit has, as the specific member, a feeding member for feeding, from the storage unit, sheets stored in the storage unit in a stacked state, and the shifting unit shifts the hybrid sheets in the width direction such that a position, in the width direction, of the predetermined feature portion of each paper sheet recognized by the recognition unit is displaced from a position, in the width direction, of the feeding member in the storage unit.

5. The sheet handling machine according to claim 4, wherein the shifting unit is configured to shift the hybrid sheet in the width direction such that the specific member of the storage unit contacts with the first portion of the hybrid sheet stored in the storage unit.

6. The sheet handling machine according to claim 2, wherein the recognition unit and the shifting unit are connected by a linear transport path in the transport unit.

7. The sheet handling machine according to claim 1, wherein the predetermined material of the hybrid sheet is a polymer film.

8. The sheet handling machine according to claim 7, wherein the hybrid sheet is a hybrid banknote that includes the paper and the polymer film.

* * * * *